US006942086B2

(12) United States Patent
Bridges et al.

(10) Patent No.: US 6,942,086 B2
(45) Date of Patent: Sep. 13, 2005

(54) TRANSFER APPARATUS FOR TRANSFERRING A WORKPIECE FROM A MOVING ANVIL TO A MOVING CARRIER

(75) Inventors: Russell Pearce Bridges, Cincinnati, OH (US); John Frederick Droste, Blue Ash, OH (US); Nathan Alan Gill, Loveland, OH (US); Ron Herbert Helton, Cincinnati, OH (US); Maite Iraolagoitia, Cincinnati, OH (US); Charles Phillip Miller, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 137 days.

(21) Appl. No.: 10/302,293

(22) Filed: Nov. 22, 2002

(65) Prior Publication Data

US 2004/0099114 A1 May 27, 2004

(51) Int. Cl.[7] ..... B65G 47/24

(52) U.S. Cl. ..... 198/377.08; 198/471.1; 198/474.1

(58) Field of Search ..... 198/377.08, 471.1, 198/474.1, 476.1

(56) References Cited

U.S. PATENT DOCUMENTS

| | | | | |
|---|---|---|---|---|
| 2,359,432 A | * | 10/1944 | McNamara | 198/471.1 |
| 4,298,422 A | | 11/1981 | Zodrow | |
| 4,300,967 A | | 11/1981 | Sigl | |
| 4,397,704 A | | 8/1983 | Frick | |
| 4,486,192 A | | 12/1984 | Sigl | |
| 4,578,133 A | | 3/1986 | Oshefsky et al. | |
| 4,596,545 A | | 6/1986 | Greenwell | |
| 4,648,928 A | | 3/1987 | Ales | |
| 4,726,876 A | | 2/1988 | Tomsovic, Jr. | |
| 4,901,843 A | * | 2/1990 | Lashyro | 198/471.1 |
| 5,104,116 A | | 4/1992 | Pohjola | |
| 5,224,405 A | | 7/1993 | Pohjola | |
| 5,407,513 A | | 4/1995 | Hayden et al. | |
| 5,556,504 A | | 9/1996 | Rajala et al. | |
| 6,139,004 A | | 10/2000 | Couillard et al. | |
| 2002/0103468 A1 | | 8/2002 | Nakakado et al. | |

FOREIGN PATENT DOCUMENTS

| | | |
|---|---|---|
| GB | 2 302 326 A | 1/1997 |
| WO | WO 95/10472 A1 | 4/1995 |
| WO | WO 00/00419 A1 | 1/2000 |
| WO | WO 01/02277 A2 | 1/2001 |

* cited by examiner

*Primary Examiner*—Joseph Valenza
(74) *Attorney, Agent, or Firm*—Jack L. Oney, Jr.; Jay A. Krebs; Ken K. Patel

(57) ABSTRACT

A transfer apparatus is provided for transferring a workpiece from a moving anvil to a moving carrier. The apparatus comprises: a support structure comprising a support member rotatable about a first axis, and a workpiece gripping structure mounted to the support structure comprising at least one workpiece gripping member having a workpiece-receiving surface. The gripping member is rotatable about a second axis substantially parallel to the first axis such that the gripping member is capable of being rotated about the second axis during transfer of a workpiece from the moving anvil to the workpiece-receiving surface. The workpiece gripping member is also rotatable about a third axis substantially transverse to the first and second axes so as to be capable of rotating the workpiece from a first angular position at the anvil to a second angular position.

20 Claims, 13 Drawing Sheets

TRANSFER APPARATUS FOR TRANSFERRING A WORKPIECE FROM A MOVING ANVIL TO A MOVING CARRIER

TECHNICAL FIELD AND INDUSTRIAL APPLICABILITY OF THE INVENTION

The present invention relates to a workpiece transfer apparatus and, more particularly, to an apparatus capable of receiving a first workpiece from a moving anvil and transferring the first workpiece to a moving second workpiece or conveyor.

BACKGROUND OF THE INVENTION

U.S. Pat. No. 5,224,405 discloses a transfer roll 28 provided with a plurality of puck assemblies 54 for receiving web strips 18, 20 from a cutting assembly 4 and for rotating and transferring them to a substrate 14. Each puck assembly 54 comprises a generally rectangular, pivotable puck 74. The pucks 74 are capable of rotating with the transfer roll 28 about its axis of rotation and, further, are capable of rotating about an axis transverse to the axis of rotation of the transfer roll 28. However, the pucks 74 do not rotate about a further axis generally parallel to the axis of rotation of the transfer roll 28 during transfer of a web strip 18, 20 from a vacuum anvil roll 32 to a puck 74. Hence, a gap between a strip 18, 20, secured to the vacuum anvil roll 32, and the puck 74, during transfer of the web strip 18, 20 from the cutting assembly 4 to the puck 74, may vary substantially unless the puck 74 is generally deformable so as to deform to the shape of the anvil roll 32 during workpiece transfer. If the gap between the strip/anvil roll and the puck 74 increases substantially during workpiece transfer, improper transfer of the strip 18, 20 to the puck 74 may occur due to the vacuum from the puck 74 being insufficient at the larger gap size to pull the strip 18, 20 to the puck 74.

International Application WO 00/00419 also discloses a workpiece transfer apparatus. The apparatus comprises a rotatable drum 30 having a plurality of rotatable transfer shafts 35 positioned near the drum perimeter. Each transfer shaft 35 comprises at least one transfer head 40 for receiving material from a source A. It is noted that rotation of the transfer shafts 35 is effected using a mechanical camming arrangement. Such a mechanical control arrangement is difficult to modify to accommodate workpieces of different sizes, or vary the pitch or distance between workpieces delivered to another workpiece, e.g., a continuous web, or a conveyor.

Accordingly, there is a need for a transfer device having a workpiece gripping member mounted to a rotatable shaft which, in turn, is mounted to a rotatable drum such that the gripping member rotates with the drum, rotates about an axis parallel to the drum's axis of rotation, and, if desired, can be controlled so as to rotate about an axis transverse to the drum's axis of rotation. There is also a need for a transfer device having a workpiece gripping member mounted to a rotatable shaft which, in turn, is mounted to a rotatable drum where the rotation of the shaft and, hence, the gripping member, is effected by a drive arrangement more versatile than a mechanical camming arrangement.

SUMMARY OF THE INVENTION

These needs are met by the present invention wherein a transfer apparatus is provided comprising one or more gripping members capable of rotating about first and second substantially parallel axes and a third axis which is substantially perpendicular to the first and second axes so as to receive a first workpiece from a rotating anvil and, if desired, rotate the workpiece about the third axis prior to transferring the workpiece to a moving second workpiece such that the first workpiece is positioned at a desired angle relative to the second workpiece. "Substantially perpendicular" means that the third axis may be positioned from about 80 degrees to about 100 degrees and preferably 90 degrees relative to the first and second axes. To allow for improved control and ease in modification, the transfer apparatus comprises one or more servo drive motors. "Servo drive motor," as used herein, means a motor controlled by a controller, processor, or computer and wherein the controller, processor, or computer receives feedback, e.g., regarding the position or velocity of the motor's output shaft, via an encoder or like device.

In accordance with one aspect of the present invention, a transfer apparatus is provided for transferring a workpiece from a moving anvil to a moving carrier. "Carrier," as used herein, means another workpiece, e.g., a continuous web, or a conveyor such as a conveyor belt. The apparatus comprises: a support structure comprising a support member rotatable about a first axis, and a workpiece gripping structure mounted to the support structure and comprising at least one workpiece gripping member having a workpiece-receiving surface. The gripping member is rotatable about a second axis substantially parallel to the first axis such that the gripping member is capable of being rotated about the second axis during transfer of a workpiece from the moving anvil to the workpiece-receiving surface. The workpiece gripping member may also rotate about a third axis substantially perpendicular to the first and second axes so as to be capable of rotating the workpiece from a first angular position at the anvil to a second angular position.

DETAILED DESCRIPTION OF THE PREFERRED EMBODIMENTS

Figure 1:
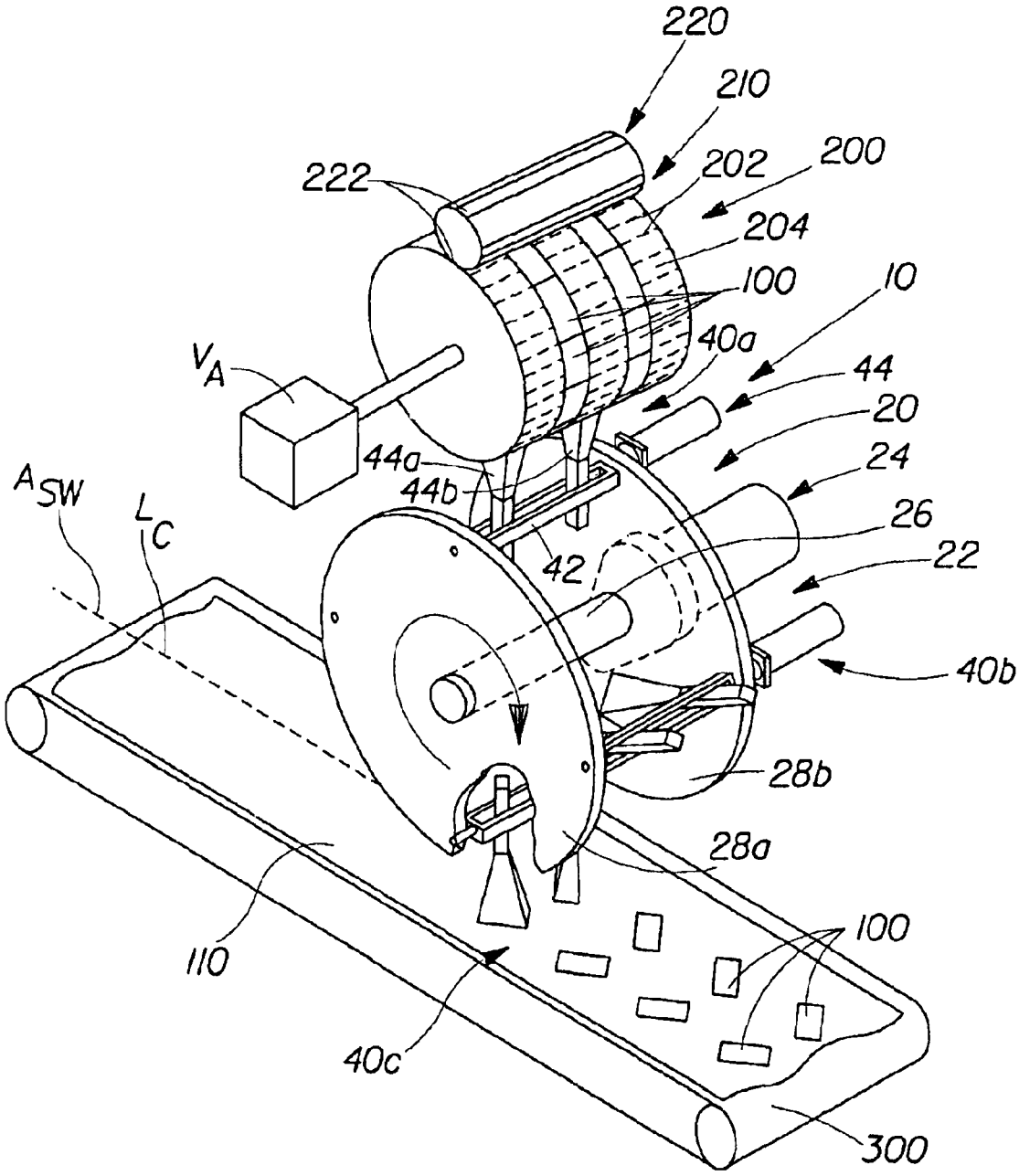
FIG. 1 is a perspective view of a transfer apparatus constructed in accordance with the present invention.
Figure 2:
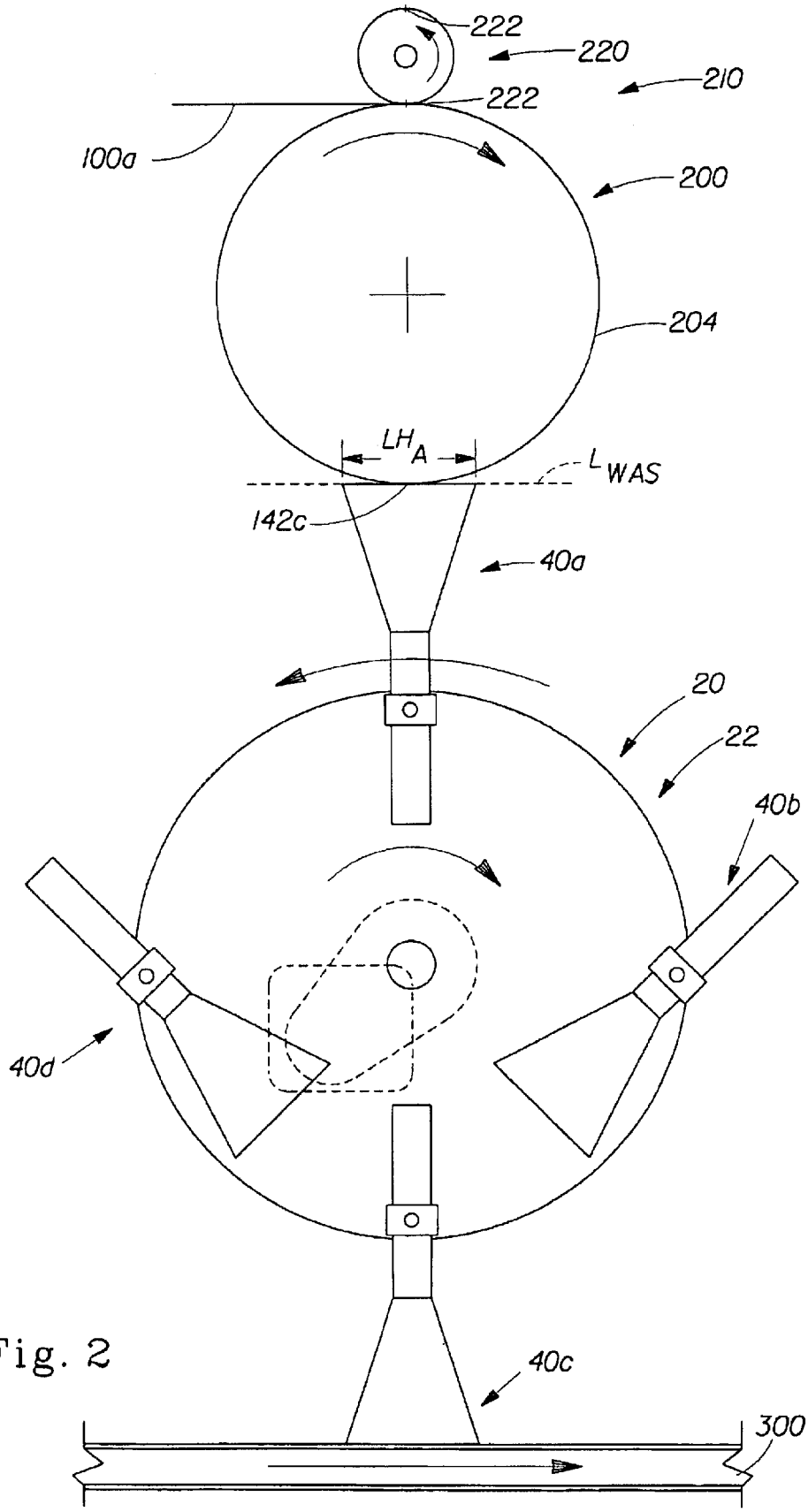
FIG. 2 is a side view of the transfer apparatus illustrated in FIG. 1 with an end plate of a support member removed.
Figure 3:
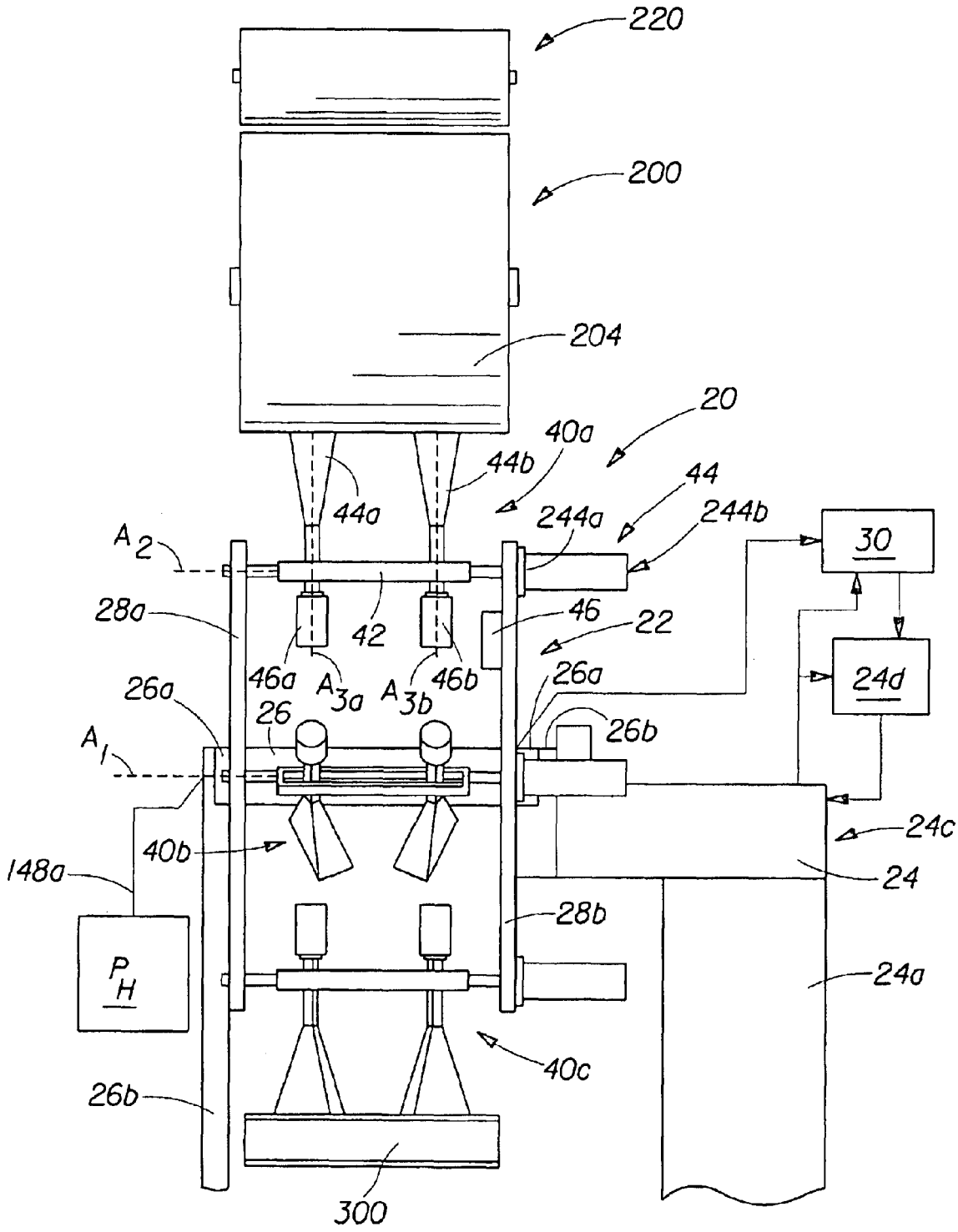
FIG. 3 is an end view of the transfer apparatus illustrated in FIG. 1.

A transfer apparatus 10 constructed in accordance with the present invention is illustrated in FIGS. 1–3. The apparatus 10 functions to receive one or more first workpieces 100, pairs of first workpieces 100 in the illustrated embodiment, from a rotating anvil 200 and transfer those first workpieces 100 at predetermined angles relative to a second workpiece 110, a continuous web 110 in the illustrated embodiment, provided on a moving conveyor 300. In the illustrated embodiment, the conveyor 300 comprises an endless belt having a substantially planar upper surface. However, the conveyor 300 may also comprise a moving element having a non-planar, e.g., circular, workpiece-receiving surface. It is also contemplated that the first workpieces 100 may comprise discrete parts or components of diapers such as leg or waist elastic pieces, or tapes, and other fasteners such as hook and loop materials or snaps. The continuous web 110 may be subsequently cut or separated into discrete diaper sections.

The anvil 200 may form part of a first workpiece cutting assembly 210 further comprising a rotatable knife roll 220. The anvil 200 may have a plurality of openings 202 in an outer portion thereof, which communicate with an inner vacuum chamber (not shown). A vacuum source $V_A$ is provided for drawing at least a partial vacuum in the inner chamber so as to retain pairs of the first workpieces 100 on the anvil's outer surface 204. The rotatable knife roll 220 is provided with a pair of cutting knives 222, each comprising a substantially straight cutting blade. The knives 222 function to cut pairs of the first workpieces 100 from a pair of continuous webs 100*a* (see FIG. 2) fed to the cutting assembly 210 via conventional conveying apparatus (not shown). Each cutting knife 222 may also comprise a die cutter for cutting shaped first workpieces, i.e., first workpieces having non-rectangular shapes.

Figure 3A:
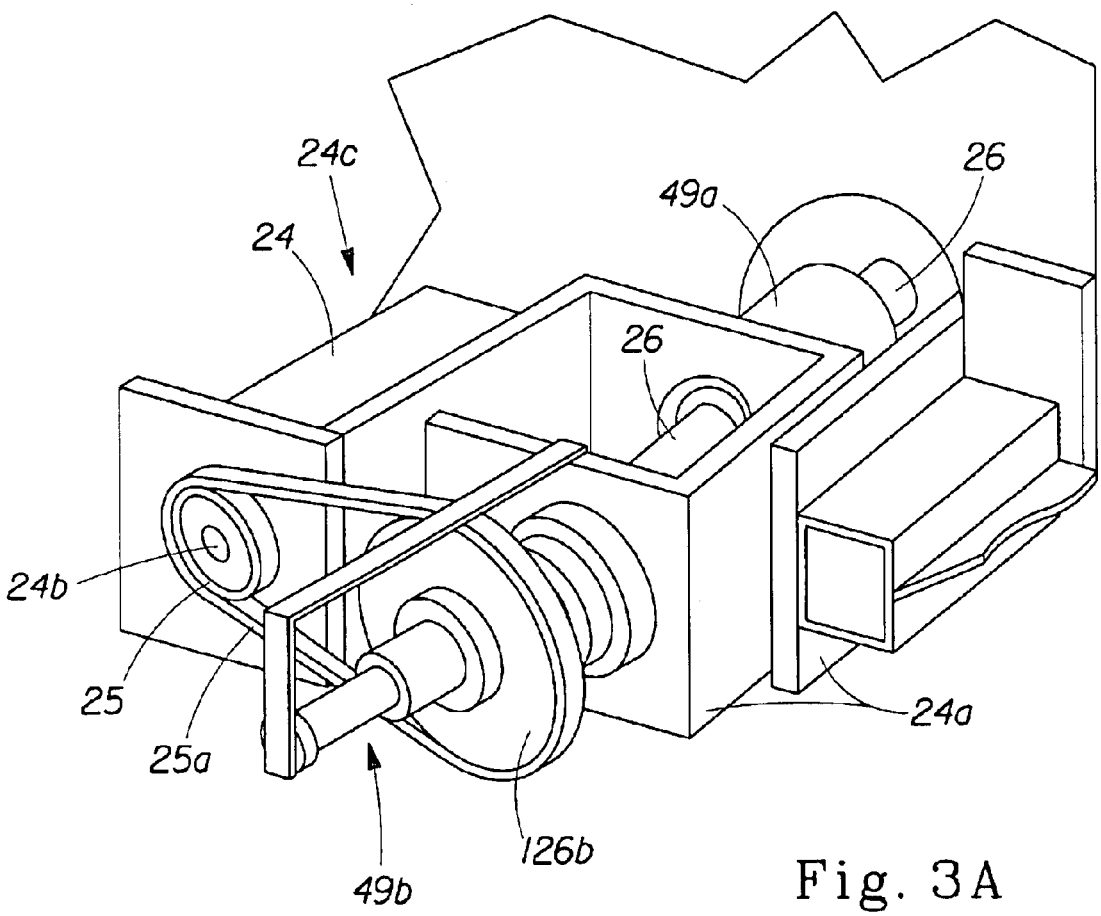
FIG. 3A is a perspective view of a first servo drive motor coupled to a support member shaft via a belt.

The transfer apparatus 10 comprises a support structure 20 comprising a support member 22 rotatable about a first axis $A_1$, see FIG. 3, and a first servo drive motor 24 for effecting rotation of the support member 22 about the first axis $A_1$. The support member 22 comprises a center shaft 26 and first and second end plates 28*a* and 28*b* fixedly coupled to the shaft 26 so as to rotate with the shaft 26. The shaft 26 is mounted via a pair of conventional bearings 26*a* to fixed frame members 26*b*, see FIG. 3. The drive motor 24 is mounted to a fixed frame member 24*a*, see also FIG. 3A. A toothed pulley 25, coupled to the output shaft 24*b* of the motor 24, causes rotation of a belt 25*a* which, in turn, drives a toothed pulley 126*b* fixedly coupled to the shaft 26. A direct drive between the motor output shaft 24*b* and the support member shaft 26 via a conventional gearing arrangement is also contemplated.

In the illustrated embodiment, the first servo drive motor 24 comprises a servo drive motor unit 24*c* including an integral encoder, one of which is commercially available from Reliance Electric under the product designation Model No. 1326AB-B530E. During operation, the motor/encoder unit 24*c* generates encoder pulses representative of the motor output shaft angular position relative to a reference point to an amplifier 24*d* and a main controller 30, see FIG. 3. The main controller 30, based on the encoder pulses, determines the angular position, including the number of complete revolutions, of the drive motor output shaft relative to the reference point and generates to the amplifier 24*d* a reference signal representative of a desired velocity for the motor at that angular position. In this case, the desired velocity will be substantially constant for all angular positions. The amplifier 24*d* determines the actual velocity of the motor using the encoder pulses, compares the actual velocity to the desired velocity as indicated by the reference signal from the main controller 30 and generates an appropriate drive (current) signal to the motor/encoder unit 24*c*, causing the motor of the unit 24*c* to effect rotation of the support member 22 at a predetermined, substantially constant angular velocity.

The transfer apparatus further comprises first, second, third and fourth workpiece gripping structures 40*a*–40*d* mounted to the support member 22, see FIGS. 1–3. In the illustrated embodiment, the workpiece gripping structures 40*a*–40*d* are structurally substantially identical. Accordingly, to simplify the discussion and for ease of understanding the invention, only the structure of the first gripping structure 40*a* will be described in detail in relation to FIGS. 1–3 and 3C. However, it is to be understood that the discussion that follows with respect to the first gripping structure 40*a* also applies to each of the remaining second, third and fourth gripping structures 40*b*–40*d*. It is also noted that some of the components comprising the second, third and fourth gripping structures 40*b*–40*d* are not illustrated. However, all illustrated components of the first gripping structure 40*a* also form part of the second, third and fourth gripping structures 40*b*–40*d*. It is also contemplated that one to three or more than four gripping structures may be provided instead of the four in the illustrated embodiment.

Figure 3B:
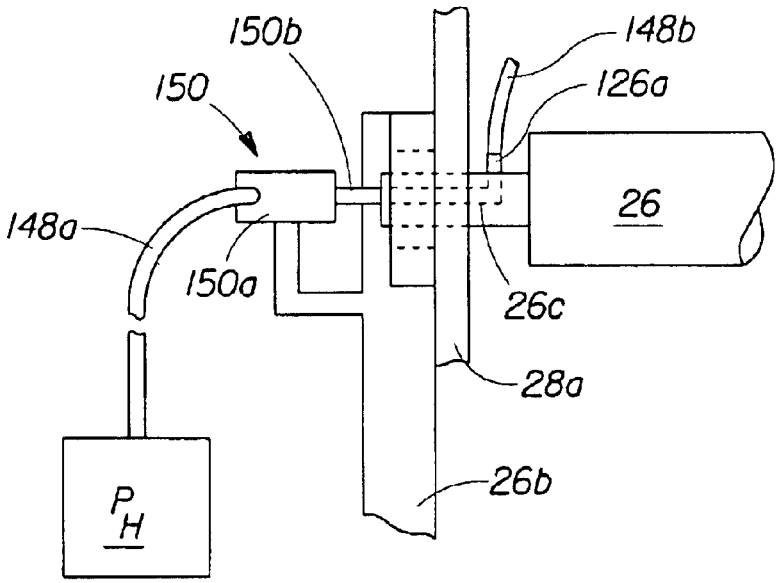
FIG. 3B is a side view of a first slip ring for allowing transfer of pressurized air from a fixed, first air line to a second air line.
Figure 3C:
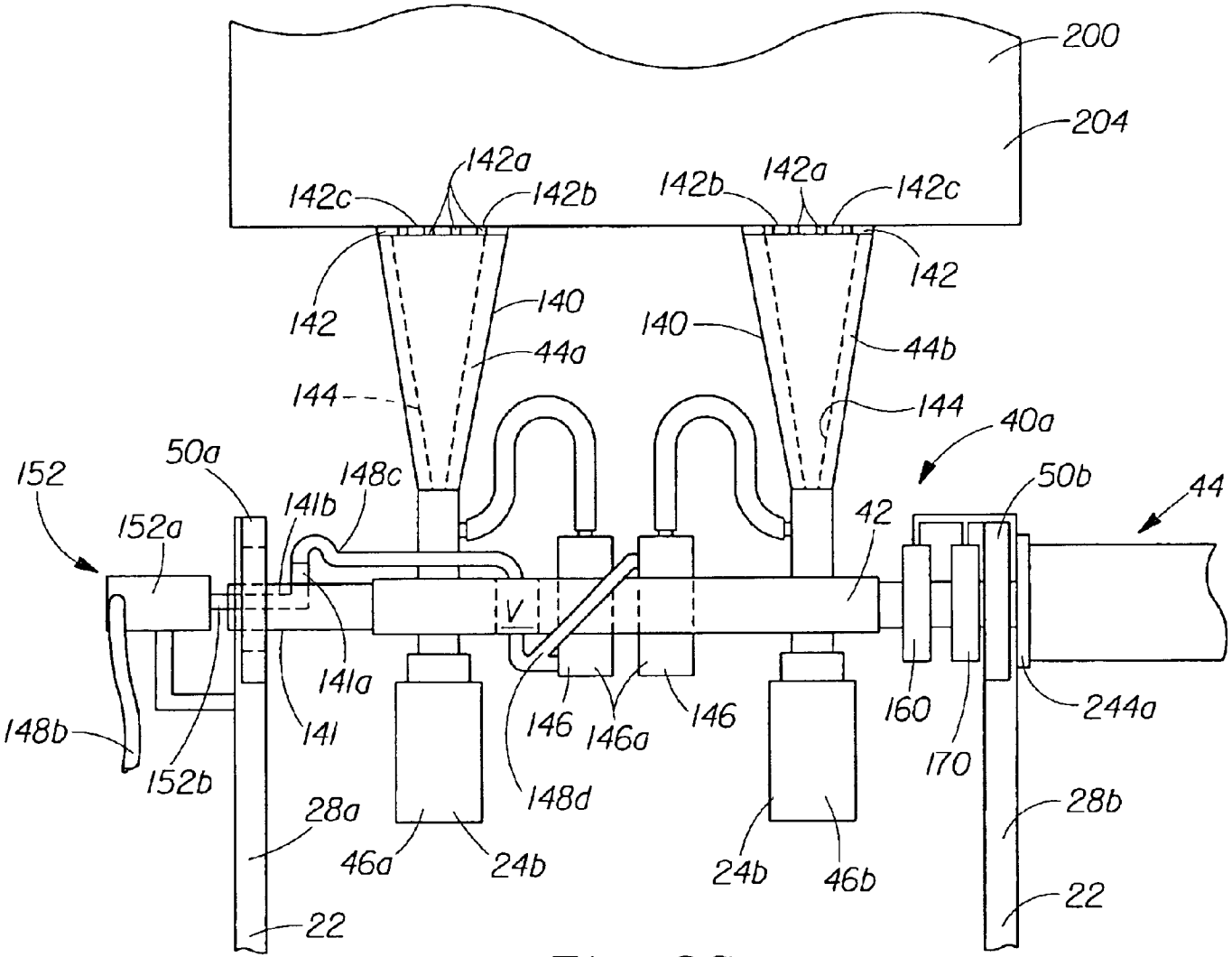
FIG. 3C is a front view of a first workpiece gripping structure.

The first gripping structure 40*a* comprises a rotatable frame 42 (also referred to herein as a "support element") mounted in bearings 50*a* and 50*b* which, in turn, are mounted to the first and second support member end plates 28*a* and 28*b*, see FIG. 3C. Hence, the first gripping structure 40*a* rotates with the support member 22 and, further, is capable of rotating about a second axis $A_2$ relative to the support member 22, see also FIG. 3. Mounted to the rotatable frame 42 for movement with the frame 42 are first and second workpiece gripping members 44*a* and 44*b*. It is also contemplated that one or more than two workpiece gripping members may be mounted to the frame 42. Each workpiece gripping member 44*a* and 44*b* comprises a main body 140 having an outer plate 142 provided with a plurality of openings 142*a* extending completely through the plate 142. A substantially planar outer surface 142*b* of the outer plate 142 defines a substantially planar workpiece-receiving surface 142*c* of the workpiece gripping member 44*a*, 44*b*. The workpiece-receiving surface 142*c* has a length $LH_A$ extending along its longitudinal axis $L_{WRS}$, see FIG. 2. A vacuum chamber 144 is provided within the main body 140 and communicates with the openings 142*a*. A pair of vacuum sources 146, corresponding to the first and second workpiece gripping members 44*a* and 44*b*, are mounted to the rotatable frame 42. Each vacuum source 146 generates a partial vacuum in the chamber 144 of its corresponding gripping member such that a first workpiece 100 (not shown in FIG. 3C) positioned adjacent to the workpiece-receiving surface 142*c* is gripped by the surface 142*c*.

It is contemplated that a single vacuum source (not shown) may alternatively be mounted so as not to rotate with the support member 22 and, further, may comprise a conventional centrifugal vacuum pump having a rotating impeller.

As will be described in more detail below, the workpiece gripping members 44*a* and 44*b* may be rotated about spaced-apart third axes $A_{3a}$ and $A_{3b}$, see FIG. 3, so as to rotate between positions for receiving first workpieces 100 from the anvil 200 and positions for depositing the first workpieces 100 on a second workpiece 110. It is preferred that the workpiece-receiving surfaces 142*c* of the gripping members 44*a*, 44*b* comprise planar surfaces so that, when the gripping members 44*a*, 44*b* are rotated through an angle, e.g., 45 degrees, a constant line of contact, extending perpendicular to the longitudinal axis of the second workpiece 110, exists between the first and second workpieces 100 and 110 during substantially the entire time of workpiece transfer.

The first and second gripping members 44*a* and 44*b* are adjustably coupled to the rotatable frame 42 by bolts (not shown) or the like so as to permit the gripping members 44*a* and 44*b* to be repositioned on the frame 42, i.e., the members 44*a* and 44*b* may be moved closer together or spaced further apart from one another along the frame 42.

In the illustrated embodiment, the vacuum source 146 comprises a conventional venturi vacuum pump 146*a*, one of which is commercially available from Anver Corporation under the product designation Model No. FT050. It is noted that a non-rotating first high pressure air line 148*a* is coupled to a high pressure air source $P_H$ and to a conventional first slip ring 150, see FIG. 3B. A first, stationary section 150*a* of the slip ring 150 is mounted to one of the fixed frame members 26*b* and a second, rotating section 150*b* of the slip ring 150 is threaded into an opening in the shaft 26, which opening defines an entrance into an air receiving chamber 26*c* provided in the shaft 26. The first high pressure air line 148*a* is coupled to the stationary section 150*a* of the slip ring 150. A second high pressure air line 148*b*, which rotates with the support member 22, extends from a fitting 126*a* coupled to the shaft 26 so as to communicate with the air receiving chamber 26*c* provided in the shaft 26, and is connected to a first, stationary section 152*a* of a second slip ring 152, see FIG. 3C. The first, stationary section 152*a* of the second slip ring 152 is mounted to the support member 22 and a second, rotatable section 152*b* is threadedly mounted into a hollow shaft portion 141 of the rotatable frame 42. A third air line 148*c*, which rotates with the frame 42, extends from a fitting 141*a* coupled to the hollow shaft portion 141 so as to communicate with an air receiving chamber 141*b* provided in the portion 141. The third air line 148*c* further communicates with a valve V and a pair of fourth air lines 148*d*, each of which extends to a corresponding pump 146*a* so as to provide high pressure air to the pump 146*a*. The valve V, which is discussed further below, controls the flow of high pressure air through the third air line 148*c*. Hence, the first slip ring 150 allows high pressure air to travel from the non-rotating first air line 148*a* to the rotating second air line 148*b*, while the second slip ring 152 allows high pressure air to travel from the second air line 148*b* to the third air line 148*c*. Using high-pressure air provided by the air lines 148*a*–148*d*, the pumps 146*a* generate a partial vacuum in the chambers 144 of the gripping members 44*a* and 44*b*.

The gripping structure 40*a* further comprises a second servo drive motor 44, coupled to the second support plate 28*b* via conventional mounting structure 244*a* for rotation with the support member 22. The second servo drive motor 44 effects rotation of the frame 42 and the gripping members 44*a* and 44*b* about the second axis $A_2$. Further provided are a pair of third servo drive motors 46*a* and 46*b* mounted to the rotatable frame 42 and coupled respectively to the first and second gripping members 44*a* and 44*b* to effect rotation of the gripping members 44*a* and 44*b* about spaced-apart third axes $A_{3a}$ and $A_{3b}$. The pair of third servo drive motors 46*a* and 46*b* rotate with the frame 42.

As a first workpiece 100 is received by a workpiece-receiving surface 142*c*, a plurality of points on the first workpiece 100, extending along a line substantially perpendicular to the axis of rotation of the anvil 200, make sequential contact with the workpiece-receiving surface 142*c* one point at a time on a continuous basis until transfer to the workpiece-receiving surface 142*c* is completed. Movement of the workpiece points along the workpiece-receiving surface 142*c* is considered equivalent to a single first transfer point moving along the surface 142*c* during workpiece transfer. The velocity at which the workpiece points move along, i.e., the velocity at which the first transfer point moves along, the workpiece-receiving surface 142*c* is referred to as "a first transfer point velocity."

As a first workpiece 100 is removed from the anvil surface 204, a plurality of points on the first workpiece 100, extending along a line substantially perpendicular to the axis of rotation of the anvil, sequentially leave the anvil surface 204 one point at a time on a continuous basis until transfer from the anvil surface 204 is completed. Movement of the workpiece points from the anvil surface 204 is considered equivalent to a single second transfer point moving along the anvil surface 204 during workpiece transfer. The velocity at which the workpiece points move along, i.e., the velocity at which the second transfer point moves along, the anvil surface 204 is referred to as "a second transfer point velocity."

In order to ensure each first workpiece 100 is properly transferred from the anvil 200 to a workpiece receiving surface 142*c*, the first transfer point velocity needs to be substantially equal to the second transfer point velocity. Too much of a difference between those two velocities will result in an improper transfer of a first workpiece 100 to a workpiece-receiving surface 142*c*, e.g., wrinkles, workpiece slipping out of position, excessive workpiece strain or tear.

The first transfer point velocity is determined as follows. It is presumed that during transfer of a first workpiece 100 to the workpiece-receiving surface 142*c*, the plurality of points on the first workpiece 100, extending along a line substantially perpendicular to the axis of rotation of the anvil 200, make sequential contact with the workpiece-receiving surface 142*c* one point at a time on a continuous and uniform basis until transfer to the workpiece-receiving surface 142*c* is completed. It is also presumed that transfer occurs during a time period $-T \leqq t \leqq T$. The first transfer point velocity, i.e., the velocity at which the first transfer point moves across the entire workpiece receiving surface length LH (defined below), in a time from t=−T to t=T, is determined as follows:

$$V_{TransferPtRelToHeadSurf}=LH/2T$$

where LH is equal to the length, i.e., length component, of the workpiece receiving surface 142*c* along an axis substantially perpendicular to the axis of the anvil 200. LH will equal $LH_A$ when the longitudinal axis $L_{WRS}$ of the workpiece receiving surface 142*c* is substantially perpendicular to the axis of the anvil 200.

Figure 8:
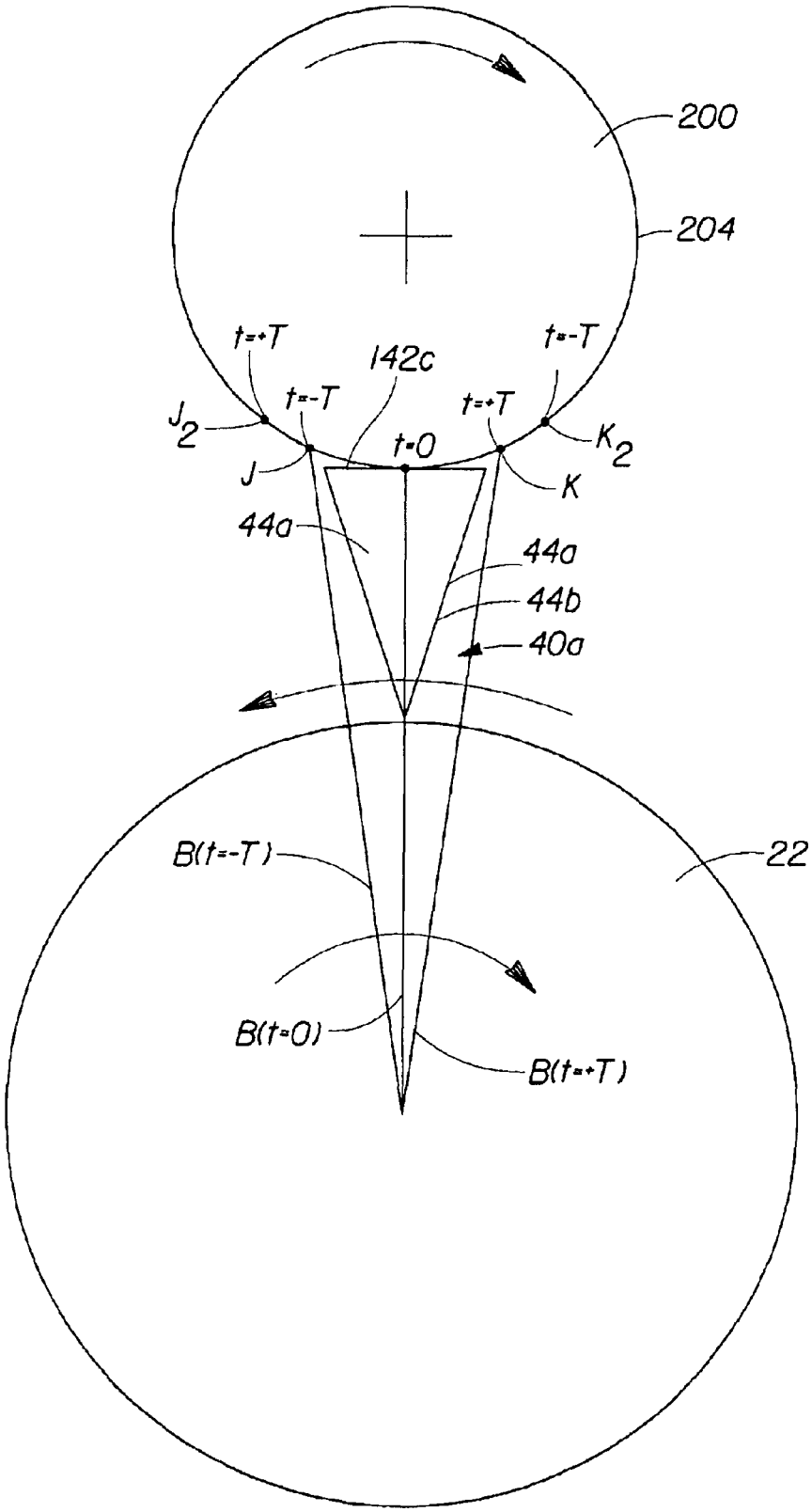
FIG. 8 is a schematic diagram used in the derivation of equations for first and second transfer point velocities.

There are two components needed to determine the second transfer point velocity. The first is the movement of the workpiece-receiving surface 142*c* relative to the anvil surface 204. Referring to FIG. 8, first workpiece transfer begins at a point (J) where the workpiece-receiving surface 142*c* is adjacent to the anvil surface 204 at time t=−T. The workpiece transfer ends at the point (K) where the workpiece-receiving surface 142*c* is adjacent to the anvil surface 204 at time t=T. The location of the second transfer point is represented by the vector B in FIG. 8. Therefore, the second transfer point is positioned at point J when time t=−T and the second transfer point is positioned at point K when time t=T. It then follows that since the vector B from t=−T to t=T represents the position of the second transfer point during transfer then $V_B$ from t=−T to t=T represents the rate at which the second transfer point moves relative to a fixed reference point during transfer. For the assumption of constant support member 22 rotational velocity and constant gripping member 44*a*, 44*b* rotational velocity during transfer, it follows that the velocity of point B, $V_B$, is constant during transfer.

$V_B$ represents the velocity of the transfer point relative to a fixed reference point. To determine the velocity of the transfer point relative to the rotating anvil surface 204, the anvil surface velocity needs to be included. The surface velocity of the anvil ($V_{AnvSurf}$) due to rotation about its center is equal to the linear velocity of the first workpiece 100. The workpiece linear velocity is the combination of the production rate and the pitch between the first workpieces 100. For first workpieces 100 that have no gap between them, the pitch is equal to the length of the first workpieces 100.

$$V_{AnvSurf}=\text{Rate}*LH$$

Rate is the first workpiece delivery rate in Hz.

Due to the anvil surface velocity ($V_{AnvSurf}$), the transfer starting point (J) will be at a new location ($J_2$) at the end of workpiece transfer (t=T), see FIG. 8. Similarly, the ending point (K) will be at a different initial location ($K_2$) at the beginning of workpiece transfer (t=−T).

The velocity of the second transfer point relative to the anvil surface 204 is the combination of the second transfer point velocity $V_B$ from point J to point K and the anvil surface velocity $V_{AnvSurf}$ from point J to point J2. The second transfer point moves from point J to point K while a point on the anvil surface 204 which corresponds with point J at t=−T moves to point J2 at t=T. Therefore the effective travel distance of the second transfer point relative to the anvil surface 204 is the arc length from point J2 to point K. The arc length from point J to point K is the product of the velocity of vector B ($V_B$) and the transfer time (2T). The length from point J to point J2 is the product of the anvil surface velocity ($V_{AnvSurf}$) and the transfer time (2T) where anvil surface speed is equal to the workpiece linear velocity.

$$\text{Length}_{JtoK}=V_B*2T$$

$$\text{Length}_{JtoJ2}=V_{AnvSurf}*2T$$

Therefore, the effective total travel of the transfer point relative to the anvil surface 204 is:

$$\text{EffectiveTotalTravel}=\text{Length}_{JtoK}+\text{Length}_{JtoJ2}$$

The velocity of the second transfer point is EffectiveTotalTravel divided by the transfer time (2T).

$$V_{TransferPtReltoAnvilSurf}=\text{EffectiveTotalTravel}/2T=V_B+V_{AnvSurf}$$

Average Velocity Mismatch between the first and second transfer point velocities is defined as the percent difference between the $V_{TransferptReltoHeadSurf}$ and $V_{TransferPtReltoAnvilSurf}$.

$$AvgVel\text{Mismatch}=[1-(V_{TransferptReltoHeadSurf}/V_{TransferPtReltoAnvilSurf})]\cdot 100\% \quad \text{EQ. A}$$

Preferably, the second drive motor 44 effects rotation of the frame 42 and the gripping members 44*a* and 44*b* about the second axis $A_2$ in conjunction with rotation of the support member 22 by the drive motor 24 such that, during transfer of a first workpiece 100 from the anvil 200 to a workpiece receiving surface 142*c* of a gripping member 44*a* and 44*b*, the first transfer point velocity is substantially equal to the second transfer point velocity. It is preferred that any difference between the first and second transfer point velocities fall within the range of from about −2.0% and +2.0%. If the difference between these velocities is less than −2.0% or greater than +2.0%, then the first workpiece 100 may stretch, bunch-up or slip on the workpiece-receiving surface 142*c* during the transfer process.

As a first workpiece 100 is received by the conveyor 300, a plurality of points on the first workpiece 100, extending along a line parallel to a longitudinal axis $L_C$ of the conveyor 300, see FIG. 1, make sequential contact with the conveyor 300 one point at a time on a continuous basis until transfer to the conveyor 300 is completed. Movement of the workpiece points along the conveyor 300 is considered equivalent to a single third transfer point moving along the conveyor 300 during workpiece transfer. The velocity at which the workpiece points move along, i.e., the velocity at which the third transfer point moves along, the conveyor 300 is referred to as "a third transfer point velocity."

As a first workpiece 100 is removed from the workpiece-receiving surface 142*c*, a plurality of points on the first workpiece 100, extending along a line substantially parallel to a longitudinal axis $L_C$ of the conveyor 300, see FIG. 1, sequentially leave the workpiece-receiving surface 142*c* one point at a time on a continuous basis until transfer from the workpiece-receiving surface 142*c* is completed. Movement of the workpiece points from the workpiece-receiving surface 142*c* is considered equivalent to a single fourth transfer point moving along the surface 142*c* during workpiece transfer. The velocity at which the workpiece points move along, i.e., the velocity at which the fourth transfer point moves along, the workpiece-receiving surface 142*c* is referred to as "a fourth transfer point velocity."

In order to ensure each first workpiece 100 is properly transferred from the workpiece receiving surface 142*c* to the conveyor 300, the third transfer point velocity needs to be substantially equal to the fourth transfer point velocity. Too much of a difference between those two velocities will result in an improper transfer of a first workpiece 100 to the conveyor 300, e.g., wrinkles, workpiece slipping out of position, excessive workpiece strain or tear.

Figure 9:
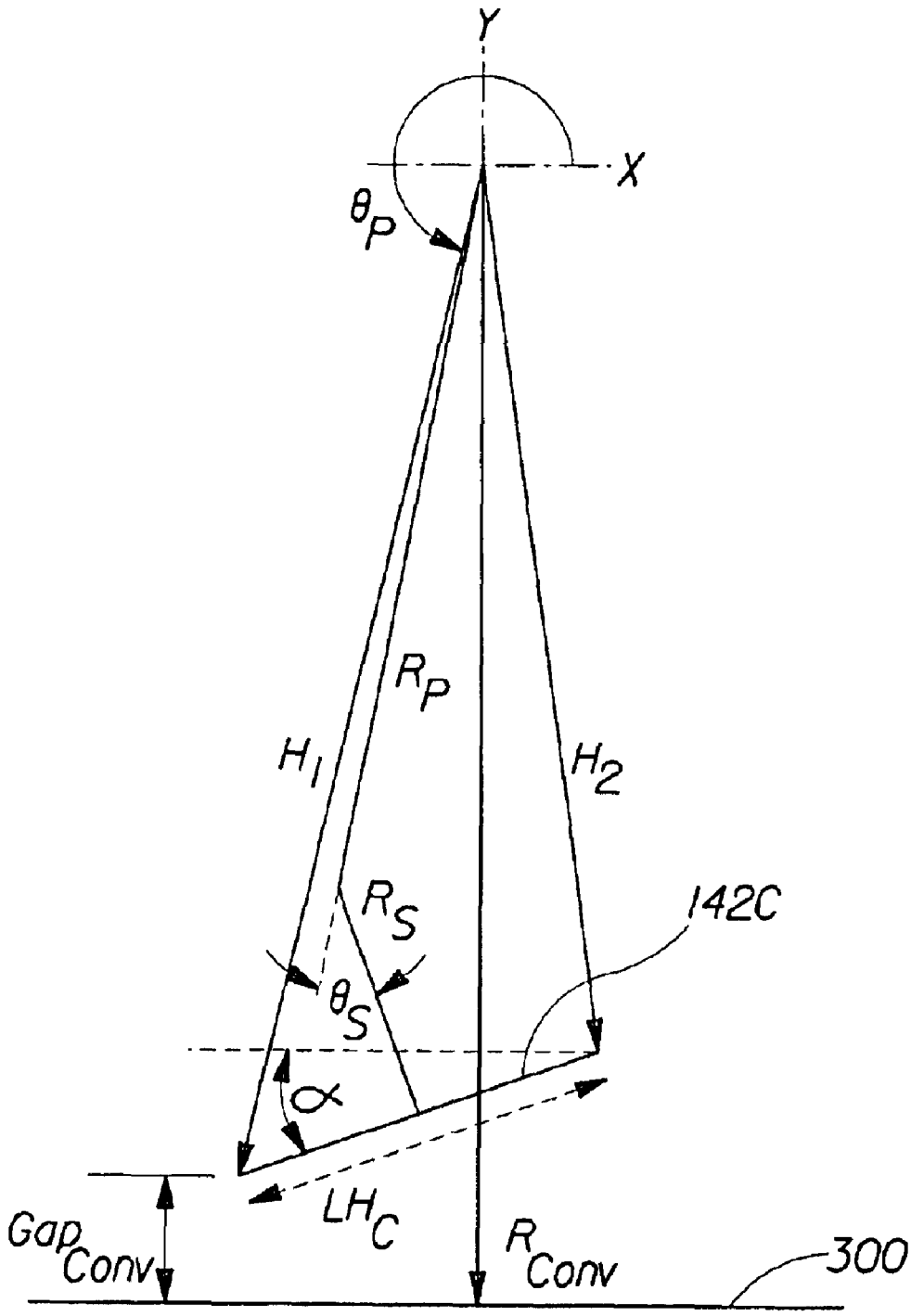
FIGS. 9 and 10 are schematic diagrams used in the derivation of equations for third and fourth transfer point velocities.
Figure 10:
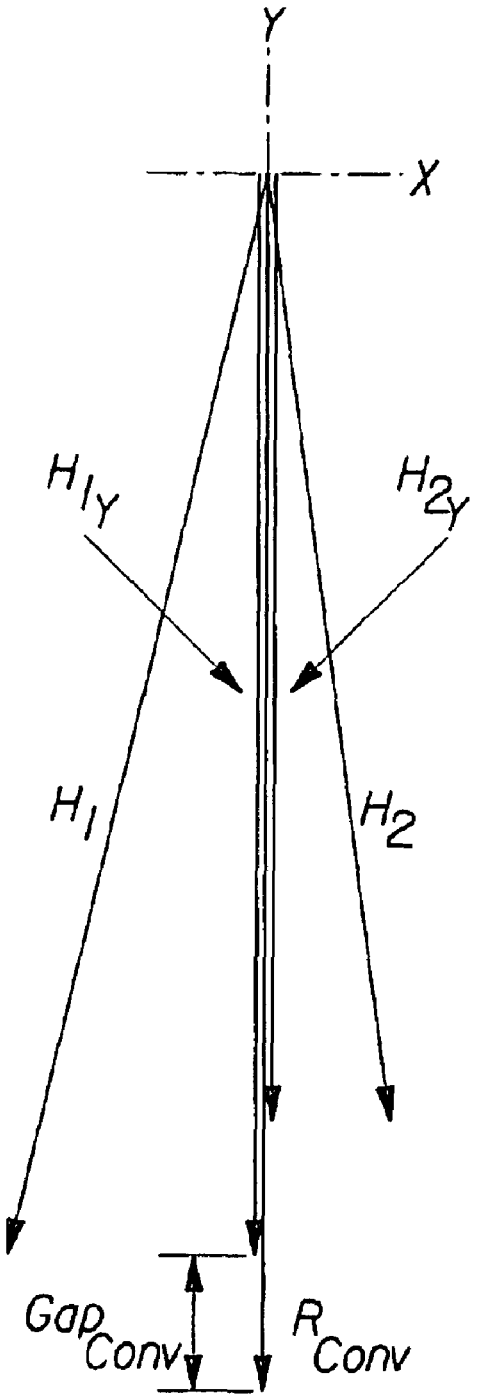

The third and fourth transfer point velocities are determined with reference to FIGS. 9 and 10 as follows.

| | |
|---|---|
| $H_1$ | Distance from the center of the support member to a first end of the workpiece receiving surface 142c; |
| $H_2$ | Distance from the support member center to a second end of the workpiece receiving surface 142c; |
| $H_{1y}$ | Component of $H_1$ in the y direction; |
| $H_{2y}$ | Component of $H_2$ in the y direction; |
| $H_{1x}$ | Component of $H_1$ in the x direction; |
| $H_{2x}$ | Component of $H_2$ in the x direction; |
| $LH_C$ | Length, i.e., length component, of workpiece-receiving surface 142c along an axis parallel to the longitudinal axis $L_C$ of the conveyor 300; |
| $R_P$ | Support member radius; |
| $R_S$ | Gripping member radius; |
| $R_{Conv}$ | Perpendicular distance from the support member center to the conveyor 300; |
| $Gap_{Conv}$ | Distance between the workpiece receiving surface 142c and the flat surface of conveyor 300; |

-continued

| | |
|---|---|
| $T_{Conv}$ | One half of the total transfer time for transferring a first workpiece from a workpiece-receiving surface 142c to the conveyor 300; |
| $Pitch_{Conv}$ | Center to center distance between consecutive workpieces on the conveyor 300; and |
| t | Time representing a instance during the transfer of a workpiece from the workpiece receiving surface to the conveyor. t = 0 is when θp = 3π/2. |

$$H_{1x}(t) = R_p \cdot \cos(\theta_p(t)) + R_s \cdot \cos(\theta_s(t) + \theta_p(t)) + \frac{LH_c}{2} \cdot \cos\left(\theta_s(t) + \theta_p(t) - \frac{\pi}{2}\right) \quad \text{EQ. B}$$

$$H_{1y}(t) = R_p \cdot \sin(\theta_p(t)) + R_s \cdot \sin(\theta_s(t) + \theta_p(t)) + \frac{LH_c}{2} \cdot \sin\left(\theta_s(t) + \theta_p(t) - \frac{\pi}{2}\right) \quad \text{EQ. C}$$

$$H_{2x}(t) = R_p \cdot \cos(\theta_p(t)) + R_s \cdot \cos(\theta_s(t) + \theta_p(t)) - \frac{LH_c}{2} \cdot \cos\left(\theta_s(t) + \theta_p(t) - \frac{\pi}{2}\right) \quad \text{EQ. D}$$

$$H_{2y}(t) = R_p \cdot \sin(\theta_p(t)) + R_s \cdot \sin(\theta_s(t) + \theta_p(t)) - \frac{LH_c}{2} \cdot \sin\left(\theta_s(t) + \theta_p(t) - \frac{\pi}{2}\right) \quad \text{EQ. E}$$

For the simplified case with a constant support member angular velocity and constant gripping member angular velocity:

$$\theta_p(t) = \frac{3\pi}{2} + K_p t \quad \text{EQ. F}$$

$$\frac{d}{dt}\theta_p(t) = K_p \quad \text{EQ. G}$$

$$\theta_s(t) = -K_s t \quad \text{EQ. H}$$

$$\frac{d}{dt}\theta_s(t) = -K_s \quad \text{EQ. I}$$

Substituting equations F–I into B–E gives the following equations J–M:

$$H_{1x}(t) := R_p \cdot \cos\left(\frac{3\pi}{2} + K_p \cdot t\right) + R_s \cdot \cos\left(-K_s \cdot t + \frac{3\pi}{2} + K_p \cdot t\right) + \frac{LH_c}{2} \cdot \cos\left(-K_s \cdot t + \frac{3\pi}{2} + K_p \cdot t - \frac{\pi}{2}\right) \quad \text{EQ. J}$$

$$(t) := R_p \cdot \sin\left(\frac{3\pi}{2} + K_p \cdot t\right) + R_s \cdot \sin\left(-K_s \cdot t + \frac{3\pi}{2} + K_p \cdot t\right) + \frac{LH_c}{2} \cdot \sin\left(-K_s \cdot t + \frac{3\pi}{2} + K_p \cdot t - \frac{\pi}{2}\right) \quad \text{EQ. K}$$

$$H_{2x}(t) := R_p \cdot \cos\left(\frac{3 \cdot \pi}{2} + K_p \cdot t\right) + R_s \cdot \cos\left(-K_s \cdot t + \frac{3 \cdot \pi}{2} + K_p \cdot t\right) + \frac{-LH_c}{2} \cdot \cos\left(-K_s \cdot t + \frac{3 \cdot \pi}{2} + K_p \cdot t - \frac{\pi}{2}\right) \quad \text{EQ. L}$$

EQ. M

To solve for the angular velocity of the gripping member ($K_s$), set the linear velocity of the workpiece receiving surface 142*c* and the conveyor 300 to be equal at time t=0 sec.

$$R_p \cdot K_p - R_s(K_s - K_p) = \text{Rate} \cdot \text{Pitch}_{Conv}$$

Solving for Ks gives:

$$K_s = \frac{R_p \cdot K_p - \text{Rate} \cdot Pitch_{Conv}}{R_s} + K_p$$

$T_{Conv}$ is solved via Eq N, set out below, with $T_{Conv}$ set to the smallest value for $T_{Conv}$ which makes the equation true:

$$R_{Conv} := R_p \cdot \sin\left(\frac{3 \cdot \pi}{2} + K_p \cdot T_{Conv}\right) + R_s \cdot \sin\left[(K_p - K_s) \cdot T_{Conv} + \frac{3 \cdot \pi}{2}\right] \ldots + \frac{LH}{2} \cdot \sin\left[(K_p - K_s) \cdot T_{Conv} + \pi\right] \quad \text{EQ. N}$$

$R_{Conv}$ is selected so that $Gap_{Conv}$, defined below, is never less than 0.0 mm.

Let $H_{max}$ be the absolute maximum of $H_{1y}(t)$ and $H_{2y}(t)$ over the range $-T_{Conv}<t<T_{Conv}$. Then the gap is the difference between $R_{Conv}$ and $H_{max}$ and is solved via equation O, set out below.

$$Gap_{Conv} = R_{Conv} - H_{max} \quad \text{EQ. O}$$

$T_{conv}$, $R_{Conv}$, $H_{Max}$, and $Gap_{Conv}$ are determined/solved using an iterative process via equations K, M, N and O set out above.

The velocity of the fourth transfer point relative to the workpiece receiving surface 142*c* is the length $LH_C$ of the workpiece receiving surface 142*c* along an axis parallel to the longitudinal axis $L_C$ of the conveyor 300 divided by the time it takes for the transfer to occur ($2*T_{Conv}$).

$$V_{ConvTranPtReltoWorkpieceSurface} = LH_C/2T_{Conv}$$

The velocity of the third transfer point relative to the surface of the conveyor 300 is the velocity of the transfer point moving across the conveyor 300 minus the velocity of the conveyor 300.

$$V_{ConvTranPtReltoConveyorSurface} = (2H_{2x}(t=T_{Conv})/2T_{Conv}) - \text{Rate} \cdot \text{Pitch}_{Conv}$$

The third and fourth transfer point velocity mismatch between the third and fourth transfer point velocities during transfer to the conveyor 300 is then solved via Equation P:

$$AvgVelMismatchAtRelease = [1 - (V_{ConvTranPtReltoconveyorSurface}/V_{ConvTranPtReltoWorkpieceSurface})] \cdot 100\% \quad \text{EQ. P}$$

Likewise, the second drive motor 44 effects rotation of the frame 42 and the gripping members 44*a* and 44*b* about the second axis $A_2$ in conjunction with rotation of the support member 22 by the drive motor 24 such that, during transfer of a pair of first workpieces 100 from the workpiece receiving surfaces 142*c* of the first and second gripping members 44*a* and 44*b* to a continuous second workpiece 110, the third transfer point velocity is substantially equal to the fourth transfer point velocity. It is preferred that any difference between the third and fourth transfer point velocities fall within the range of from about −2.0% and +2.0%.

In the illustrated embodiment, the drive motor 44 comprises a conventional servo drive motor unit 244*b* including an integral encoder, which unit 244*b* is commercially available from Allen-Bradley under the product designation Model MPL-A4540F. A conventional gear reducer (not shown) is coupled to an output shaft of the unit 244*b*. An amplifier 46 is mounted to the second support plate 28*b* and is coupled to the unit 244*b* and the main controller 30, see FIG. 3. The amplifier 46 receives power via wiring (not shown) coupled to a power supply (not shown) and a conventional slip ring 49*a* mounted to the shaft 26 and the fixed frame member 24*a,* see FIG. 3A. During operation, the servo drive motor/encoder unit 244*b* generates encoder pulses representative of the angular position of the motor's output shaft relative to a reference point to the amplifier 46. The amplifier 46 determines the actual velocity of the motor output shaft from those encoder pulses and also forwards the encoder pulses, in a substantially unmodified form, to the main controller 30. The main controller 30, based on the encoder pulses from the unit 244*b,* determines the angular position and number of complete revolutions of the drive motor output shaft of the unit 244*b* relative to the reference point. As noted above, the main controller 30, based on the encoder pulses from the unit 24*c,* also determines the angular position and number of complete revolutions of the drive motor output shaft of unit 24*c*. Based on the angular positions and number of complete revolutions of the output shafts of the units 24*c* and 244*b,* the main controller 30 generates to the amplifier 46 a reference signal representative of a desired velocity for the motor of the unit 244*b*. In this case, the desired velocity of the motor of the unit 244*b* will vary based on the angular positions and number of complete revolutions of the motor output shafts of units 24*c* and 244*b*. The amplifier 46 compares the actual velocity of the motor of the unit 244*b,* determined using the encoder pulses, to the desired velocity as indicated by the reference signal from the main controller 30 and generates an appropriate drive (current) signal to the drive motor of the unit 244*b* so as to effect rotation of the motor and, hence, the frame 42 and the gripping members 44*a* and 44*b* about the second axis $A_2$.

In particular, data is stored in the main controller 30 corresponding to the angular position and number of complete revolutions of the motor output shaft relative to a reference point for each unit 24*c* and 244*b* so that a signal is generated by the main controller 30 to the amplifier 46 representative of a desired velocity for the motor of the unit 244*b* which varies with the angular positions and number of complete revolutions of the motor output shafts of the units 24*c* and 244*b*. More particularly, the motor may be driven so as to cause the frame 42 and gripping members 44*a* and 44*b* to rotate in accordance with the displacement, velocity and acceleration curves illustrated in FIGS. 4A and 4B. The signal from the main controller 30 to the amplifier 46 and the encoder signals from the amplifier 46 to the main controller 30 pass through a slip ring 49*b* mounted at the end of the shaft 26 and to the fixed frame member 24*a,* see FIG. 3A.

Figure 4A:
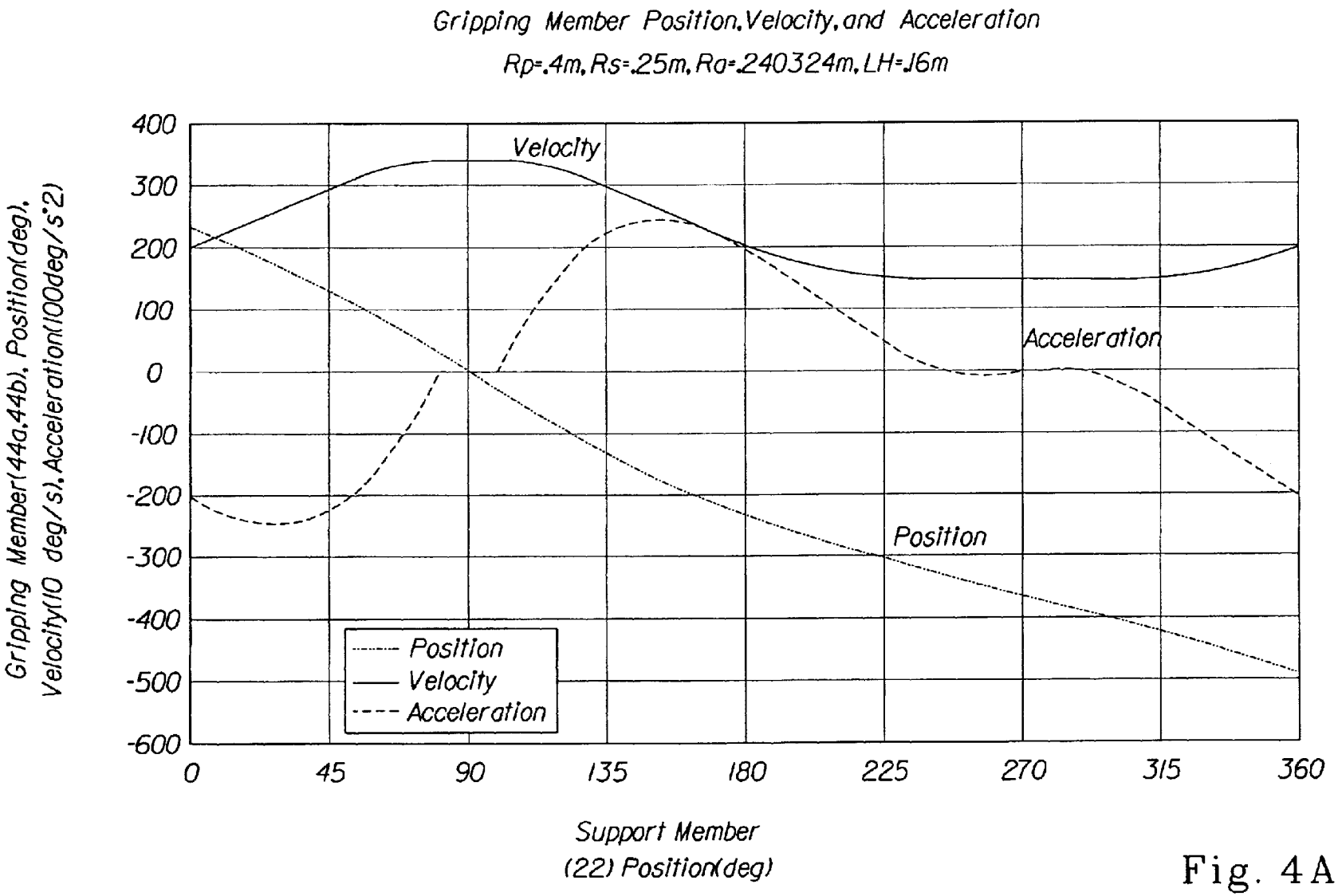
FIG. 4A is a view of displacement, velocity and acceleration curves for a gripping member of a transfer apparatus of Example 1.

The angular displacement, angular velocity (relative to the support member 22) and angular acceleration (relative to the support member 22) of the frame 42 and the first and second workpiece gripping members 44*a* and 44*b* as a function of angular position of the support member 22 is illustrated in FIG. 4A for a transfer apparatus of Example 1, set out below, and in FIG. 4B for a transfer apparatus of Example 2, also set out below. With regard to FIGS. 4A and 4B, a pair of first workpieces 100 are transferred from the anvil 200 to the first and second workpiece gripping members 44*a* and 44*b* when the support member 22 is positioned at approximately 90 degrees and the workpieces 100 are transferred from the gripping members 44*a* and 44*b* to a pair of continuous second workpieces 110 when the support member 22 is positioned at approximately 270 degrees.

Figure 5:
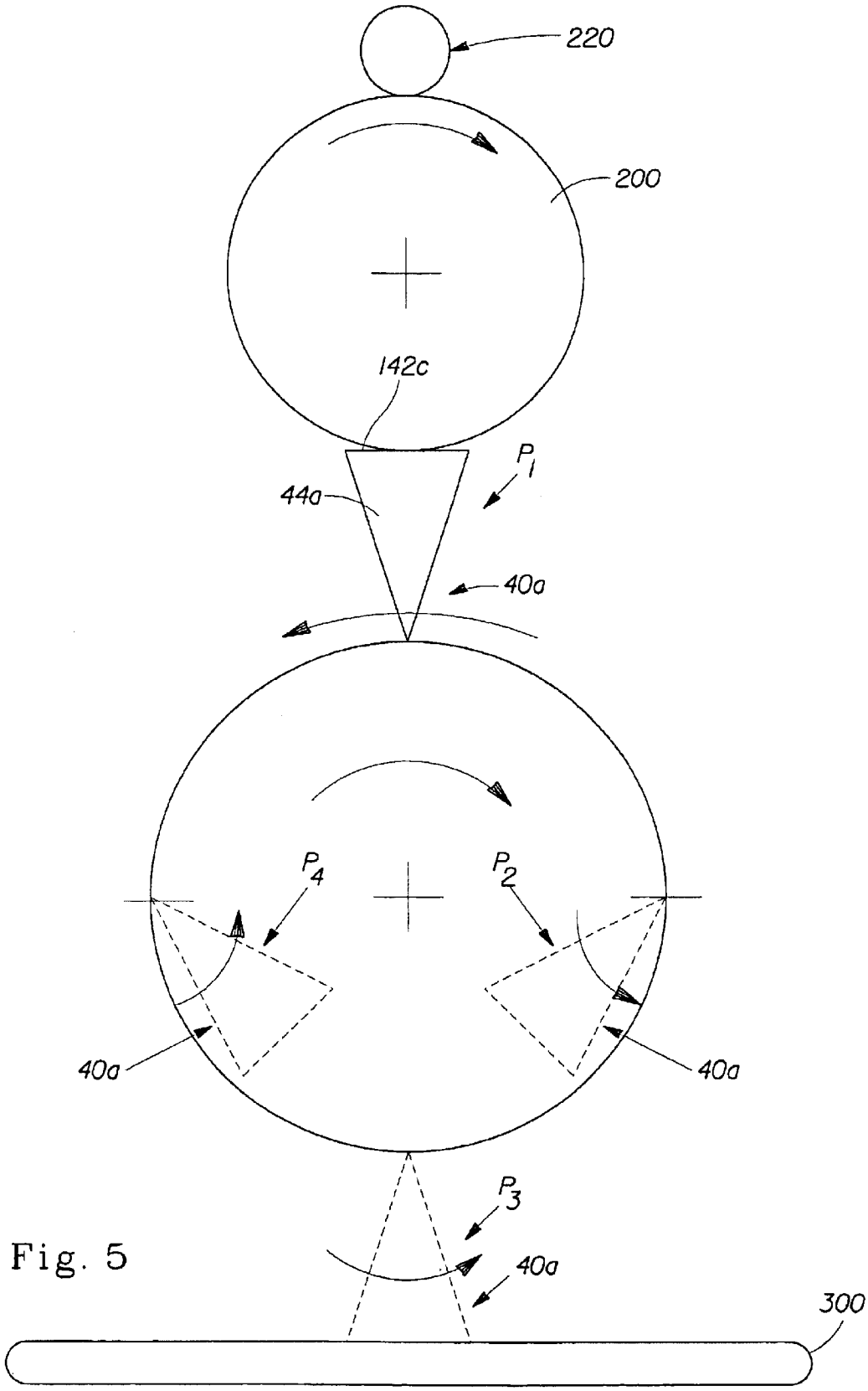
FIG. 5 is a view illustrating four separate angular positions of a gripping member corresponding to four angular positions of a support member.

In FIG. 5, a first angular position $P_1$ of the first workpiece gripping member 44*a* is illustrated in solid line while the support member 22 is located at a first angular position. Also illustrated in FIG. 5, in phantom, are: a second angular position $P_2$ of the first workpiece gripping member 44*a* when the support member 22 has rotated to a second angular position, 90 degrees from the first position; a third angular position $P_3$ of the first workpiece gripping member 44*a* when the support member 22 has rotated to a third angular position, 180 degrees from the first position; and a fourth angular position $P_4$ of the first workpiece gripping member 44*a* when the support member 22 has rotated to a fourth angular position, 270 degrees from the first position. The second gripping member 44*b* is not shown in FIG. 5 but will have substantially the same angular positions to those illustrated in solid line and phantom for the first gripping member 44*a*.

Figure 4B:
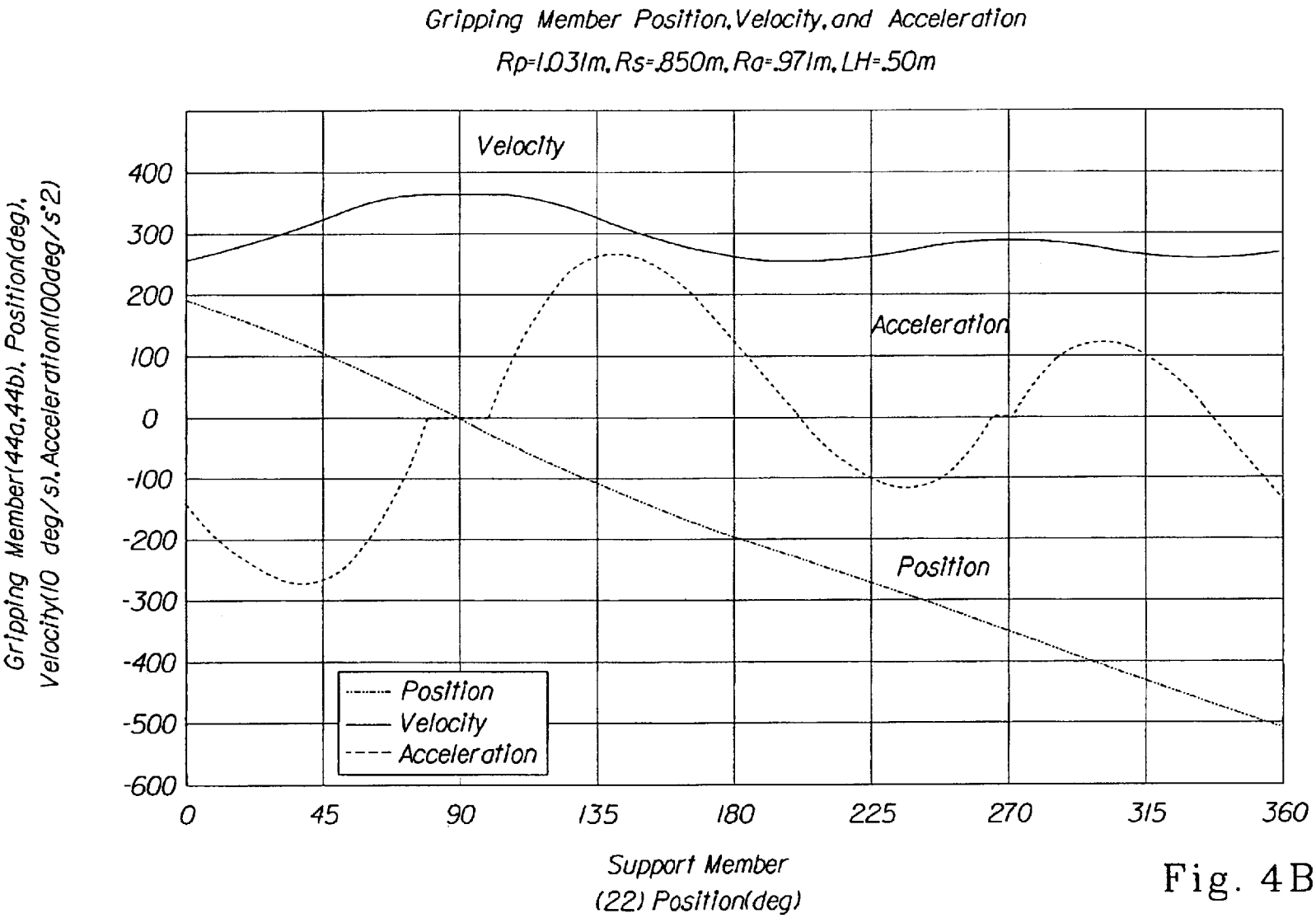
FIG. 4B is a view of displacement, velocity and acceleration curves for a gripping member of the transfer apparatus of Example 2.

In the illustrated embodiment, the support member 22 rotates in a clockwise direction, as illustrated in FIG. 1, at a substantially constant angular velocity and the rotatable frame 42 rotates in a counter-clockwise direction, in accordance with a velocity curve such as the one illustrated in FIG. 4A or FIG. 4B. It is contemplated that both the support member 22 and the rotatable frame 42 may rotate in the same direction. In such an embodiment, the velocity curve of the rotatable frame 42 and the first and second workpiece gripping members 44*a* and 44*b* will be modified so as to ensure that the first transfer point velocity is substantially equal to the second transfer point velocity and the third transfer point velocity is substantially equal to the fourth transfer point velocity.

Preferably, the radius $R_P$ of the support member 22 (discussed below), the radius $R_S$ of each gripping member 44*a,* 44*b* (discussed below), the radius $R_A$ of the anvil 200 (discussed below), the length LH of each workpiece-receiving surface 142*c* along an axis perpendicular to the axis of the anvil 200, see FIG. 6, the constant angular velocity of the support member 22, the angular velocity of each gripping member 44*a,* 44*b* during transfer of a first workpiece 100 from the anvil 200 to a workpiece-receiving surface 142*c,* and a transfer time T (discussed below) are defined such that a gap (not shown) between the nearest point on a planar workpiece-receiving surface 142*c* of a gripping member 44*a,* 44*b* to a corresponding, opposing point on the anvil outer surface 204 during workpiece transfer is between about 0 mm and 2 mm. If the gap is less than 0 mm, the corresponding gripping member 44*a* and 44*b* will crash into the anvil 200. If the gap is greater than 2 mm, there is an increased likelihood that the vacuum generated by the corresponding gripping member 44*a,* 44*b* will be insufficient to remove the first workpiece 100 from the anvil and/or the first workpiece 100 may wrinkle or otherwise become damaged during the transfer from the anvil 200 to the surface 142*c*. The gap between the closest point on a planar workpiece-receiving surface 142*c* of a gripping member 44*a,* 44*b* to a corresponding, opposing point on the anvil outer surface 204 during workpiece transfer may be calculated using the equation for $Gap_A$ set out below.

During workpiece transfer, the vacuum applied by the anvil 200 to a workpiece 100 is less than the vacuum applied by a workpiece-receiving surface 142*c* of a gripping member 44*a,* 44*b*.

It is also preferred that the radius $R_P$ of the support member 22, the radius $R_S$ of each gripping member 44*a,*

44*b,* the radius $R_A$ of the anvil 200, the length $LH_C$ of each workpiece-receiving surface 142*c* along an axis parallel to the longitudinal axis $L_C$ of the conveyor 300, the constant angular velocity of the support member 22, the angular velocity of each gripping member 44*a,* 44*b,* the perpendicular distance $R_{Conv}$ from the support member center to the conveyor 300, and one-half of the total transfer time $T_{Conv}$ are defined such that a gap between the nearest point on a planar workpiece-receiving surface 142*c* of a gripping member 44*a,* 44*b* to a corresponding, opposing point on the conveyor 300 during workpiece transfer is between about 0 mm and 2 mm. During workpiece transfer, the vacuum applied by a workpiece-receiving surface 142*c* of a gripping member 44*a,* 44*b* is removed just before a first workpiece 100 is transferred to a second workpiece 110. The valve V, illustrated in FIG. 3C, comprises a solenoid-operated valve and is controlled by the controller of unit 46A. The valve V is mounted to the rotatable frame 42 and coupled to the third air line 148*c* so as to control the flow of pressurized air to the pumps 146*a*. Alternatively, during workpiece transfer, the vacuum applied by a workpiece-receiving surface 142*c* of a gripping member 44*a,* 44*b* is less than that applied by a vacuum source (not shown) associated with the conveyor 300. The gap between the closest point on a planar workpiece-receiving surface 142*c* of a gripping member 44*a,* 44*b* to a corresponding, opposing point on the conveyor 300 during workpiece transfer may be calculated using the equation for $Gap_{Conv}$ set out above.

The planar workpiece-receiving surface 142*c* of each gripping member 44*a,* 44*b* preferably has a length $LH_A$ (see FIG. 2) extending along the longitudinal axis $L_{WRS}$ of the workpiece receiving surface 142*c* between about 25 mm and 500 mm, including all ranges subsumed therein, and more preferably from about 25 mm to about 175 mm. The length $LH_A$ preferably extends transverse to the first and second axes $A_1$ and $A_2$ during transfer of a workpiece 100 from the moving anvil 200 to the workpiece-receiving surface 142*c*.

Once the length $LH_A$ of the workpiece-receiving surface 142*c* has been defined, the gripping members 44*a,* 44*b* are capable of receiving from the anvil 200 first workpieces 100 having a length equal to or less than the length $LH_A$ of the workpiece-receiving surface 142*c*.

It is contemplated that a first gap between adjacent edges of sequential first workpieces 100 provided on the anvil 200 may be 0 or equal to a first predefined length. The speed of the rotatable member 42 and first and second workpiece gripping members 44*a* and 44*b* may be varied so that a second gap between those same first workpieces 100, after being transferred to a corresponding second workpiece 110, is equal to a second predefined length, which is not equal to the length of the first gap. Alternatively, the second predefined length may be equal to the length of the first gap.

As noted above, the workpiece gripping members 44*a* and 44*b* are rotatable about a pair of space-apart third axes $A_{3a}$ and $A_{3b}$ via third servo drive motors 46*a* and 46*b*. In particular, the drive motors 46*a* and 46*b* are controlled so as to rotate the first workpieces 100 from a first angular position at the anvil 200 to a desired, second angular position so that the first workpieces 100 are transferred to and positioned relative to the second workpiece 110 at the second angular position. For example, the first workpieces 100 may be rotated by the gripping members 44*a* and 44*b* from a first angular position relative to the anvil 200 (in FIG. 1, the longitudinal axis of each first workpiece 100 on the anvil 200 is positioned substantially 90 degrees to the axis of rotation of the anvil 200) through an angle of between about 1 degree and 359 degrees, including all ranges subsumed therein, and preferably between about 5 degrees and 180 degrees (in FIG. 1, the longitudinal axis of each first workpiece 100 is positioned at an angle of about 45 degrees relative to the longitudinal axis $A_{SW}$ of the second workpiece 110).

Each third servo drive motor 46*a,* 46*b* comprises a servo motor unit 246 including an integral encoder and controller, one of which is commercially available from Animatics Corporation under the product designation SM1720, which unit 246 is coupled to the rotatable frame 42. A conventional gear reducer (not shown) is coupled to the output shaft of each unit 246. A slip ring 170, shown only in FIG. 3C, is mounted to the rotatable frame 42 and the second end plate 28*b* of the support member 22. Wiring (not shown) delivering power to the units 246 is coupled to the slip rings 49*a* and 170 and a power supply source (not shown). A separate encoder 160 is coupled to the rotatable frame 42 and the second end plate 28*b* and generates encoder pulses representative of the angular position of the frame 42 relative to the end plate 28*b*. Those encoder pulses are provided to the controller of each unit 246 such that each controller generates a drive signal to its corresponding servo motor causing the motor to rotate a corresponding gripping member 44*a,* 44*b* through a predefined angle which varies as a function of the angular position of the rotatable frame 42. That is, for each angular position of the rotatable frame 42, there is a corresponding angular position for each of the gripping members 44*a,* 44*b*. Hence, the controller of each unit 246 generates an appropriate drive signal to its drive motor to effect rotation of its gripping member 44*a,* 44*b* such that the first workpieces 100 are rotated through a desired angle prior to being transferred to the second workpiece 110. It is also contemplated that the motors of the units 246 may not be activated such that the workpieces 100 are not rotated after being received by the gripping members 44*a,* 44*b* from the anvil 200 and prior to being transferred to the second workpiece 110. It is further contemplated that the controllers of each unit 246 may be easily re-programmed to vary the amount of angular rotation of each first workpiece 100.

EXAMPLE I

It is contemplated that a transfer apparatus having four workpiece gripping structures 40*a*–40*d* equally spaced about a support member 22 may be constructed in accordance with the present invention as follows. The support member 22 has a radius $R_P$ of 0.4 m; each gripping member 44*a,* 44*b* has a radius $R_S$ of 0.25 m; and the anvil 200 has a radius $R_A$ of 0.240324 m, see FIG. 6. Each workpiece-receiving surface 142*c* of each gripping member 44*a,* 44*b* has a length $LH_A$ extending along its longitudinal axis $L_{WRS}$ equal to about 0.16 m; a length LH extending along an axis perpendicular to the axis of the anvil 200 during transfer from the anvil 200 of about 0.16 m and a length $LH_C$ extending along an axis parallel to the longitudinal axis $L_C$ of the conveyor 300 during transfer to the conveyor 300 of about 0.16 m. Pairs of first workpieces 100 are transferred from the anvil 200 at a rate of 750 pairs per minute. The anvil 200 is rotated at a constant angular velocity of about 8.322 radians/second, the support member 22 is rotated at a substantially constant angular velocity of about 19.635 radians/second, and each workpiece gripping member 44*a,* 44*b* is rotated at an angular velocity corresponding to the velocity curve illustrated in FIG. 4A. During workpiece transfer from the anvil 200 to the gripping members 42*a,* 42*b,* the angular velocity of each gripping member 44*a,* 44*b* is substantially constant and equal to about 59.051 radians/second. Also during workpiece transfer from the anvil 200 to the gripping members 42*a,* 42*b,* by calculation, a first transfer point velocity is substantially equal to 11.473 m/s and a second transfer point velocity is equal to 11.511 m/s such that the difference between those two velocities is about 0.4%. Further, the maximum gap between any point on a planar workpiece-receiving surface 142*c* of a gripping member 44*a,* 44*b* and a corresponding, opposing point on the anvil outer surface 204 during workpiece transfer is believed to be, by calculation, between about 0 and about 0.074 mm. Still further, by calculation, the maximum gap between any point on a planar workpiece-receiving surface 142*c* of a gripping member 44*a,* 44*b* and a corresponding, opposing point on the conveyor 300 during workpiece transfer is between about 0.0 mm and 0.8 mm. During workpiece transfer from the gripping members 42*a,* 42*b* to the conveyor 300, by calculation, a third transfer point velocity is substantially equal to 25.797 m/s and a fourth transfer point velocity is equal to 25.8065 m/s such that the difference between those two velocities is about 0.04%. The pitch between first workpieces 100 on the second workpiece 110 is 0.5 m, the angular velocity of the workpiece gripping members 44*a,* 44*b* during transfer of the first workpieces 100 to the second workpiece 110 is 26.0509 radians/sec; $R_{Conv}$ is 0.6508 m and $T_{Conv}$ is 0.0031 second. The conveyor 300 may move at a linear speed of about 6.25 m/s.

EXAMPLE II

A transfer apparatus including only three workpiece gripping structures provided equally spaced about a support member 22 may be constructed as follows. The support member 22 has a radius $R_P$ of 1.031 m; each gripping member 44*a,* 44*b* has a radius $R_S$ of 0.850 m; and the anvil 200 has a radius $R_A$ of 0.971 m. Each workpiece-receiving surface 142*c* of each gripping member 44*a,* 44*b* has a length $LH_A$ extending along its longitudinal axis $L_{WRS}$ of about 0.50 m, a length LH extending along an axis perpendicular to the axis of the anvil 200 during transfer from the anvil 200 of about 0.50 m and a length $LH_C$ (i.e., length component) extending along an axis parallel to the longitudinal axis $L_C$ of the conveyor 300 during transfer to the conveyor 300 of about 0.1 m. Pairs of first workpieces 100 are transferred from the anvil 200 at rate of about 540 pairs/minute. The anvil 200 is rotated at a constant angular velocity of about 4.631 radians/second, the support member 22 is rotated at a substantially constant angular velocity of about 18.85 radians/second, and each workpiece gripping member 44*a,* 44*b* is rotated at an angular velocity corresponding to the velocity curve illustrated in FIG. 4B. During workpiece transfer from the anvil to the first workpiece receiving surfaces, the angular velocity of each gripping member 44*a,* 44*b* is substantially constant and equaled to about 47.007 radians/second. Also during workpiece transfer from the anvil 200 to the gripping members 42*a,* 42*b,* by calculation, a first transfer point velocity is substantially equal to 31.863 m/s and a second transfer point, velocity is equal to 31.847 m/s such that the difference between those two velocities is about −0.5%. Further, by calculation, the maximum gap between any point on a planar workpiece-receiving surface 142*c* of a gripping member 44*a,* 44*b* and a corresponding, opposing point on the anvil outer surface 204 during workpiece transfer is between about 0.0 mm and about 0.2 mm. Still further, by calculation, the maximum gap between any point on a planar workpiece-receiving surface 142*c* of the gripping member 44*a,* 44*b* and a corresponding, opposing point on the conveyor 300 during workpiece transfer is between about 0.09 mm and about 1.4 mm. During workpiece transfer from the gripping members 42*a,* 42*b* to the conveyor 300, by calculation, a third transfer point velocity is equal to 57.143 m/s and a fourth transfer point velocity is equal to 57.125 m/s such that the difference between those two velocities is about 0.03%. The pitch between first workpieces 100 on the second workpiece 110 is 0.5 m, the angular velocity of the workpiece gripping members 44*a,* 44*b* during transfer of the first workpieces 100 to the second workpiece 110 is 36.4 radians/sec; $R_{Conv}$ is 1.8824 m and $T_{Conv}$ is 0.0014 second. The conveyor 300 may move at a linear velocity of about 4.5 m/s.

Further equations will now be developed which can be used, along with the equations set out above, to design a transfer system 10 in accordance with the present invention.

To achieve proper first workpiece transfer, both position and velocity requirements must be met. If either the position or velocity of the workpiece receiving surface 142*c* relative to the anvil 200 is incorrect, either the workpiece 100 will not be transferred properly, or there may be a collision between the surface 142*c* and the anvil 200.

The relationships between the workpiece receiving surface and anvil surface geometry and kinetics which enable a first workpiece 100 to be transferred between the surface 142*c* and the anvil 200 will now be described.

Figure 6:
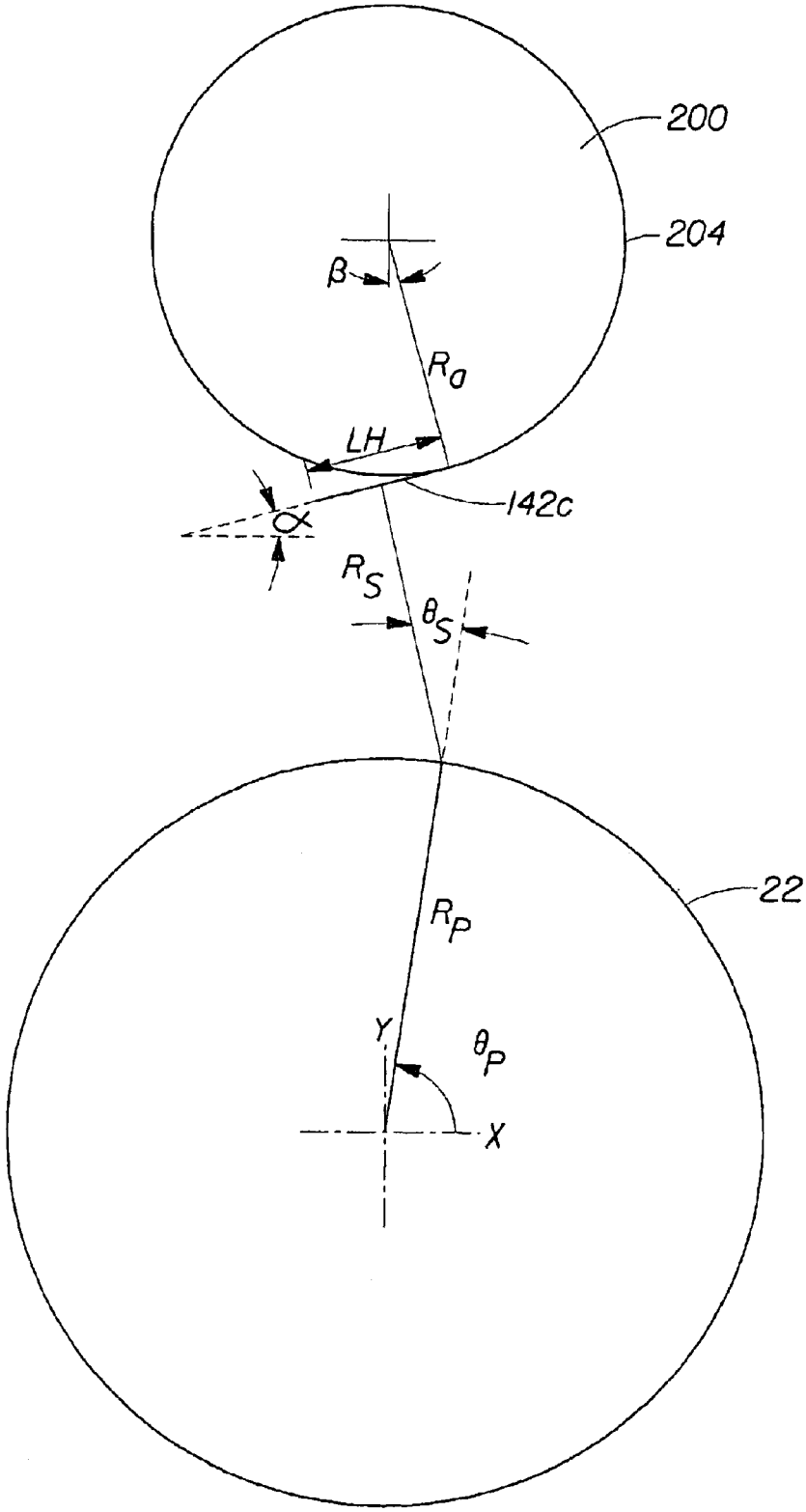
FIG. 6 is a schematic diagram illustrating defined variables relating to the anvil, support member and workpiece-receiving surface.

With regard to FIG. 6, the following variables are defined:

| Variables: | |
|---|---|
| LH | Length of workpiece receiving surface 142c along an axis perpendicular to the axis of the anvil 200 |
| $R_a$ | Anvil Radius |
| $R_p$ | Support member Radius |
| $R_s$ | Gripping member Radius |
| $\theta_p$ | Support member rotational position |
| $\theta_s$ | Gripping member rotational position relative to support member position |
| $\alpha$ | Workpiece-receiving surface angle relative to horizontal X-axis $\alpha = \theta s + \theta p - \pi/2$ |
| $\beta$ | Angle between vertical Y-axis and line from anvil center to desired workpiece-receiving surface/anvil contact point. $\beta = \alpha$ |
| t | Time in seconds from initial workpiece-receiving surface/anvil surface contact to a given position. t = 0 is when $\theta p = \pi/2$ |
| T | One half of the total transfer time for transferring a first workpiece 100 from the anvil to the workpiece receiving surface 142c. |

Assumptions:

1. Motion profile for the support member 22 and the gripping member 44*a,* 44*b* are symmetric about time t=0, i.e., the profile for $-T \leqq t \leqq 0$ is a symmetric to $0 \leqq t \leqq T$.
2. Angular velocity of support member 22 is constant.

Unknown Variables:

It is assumed that the support member radius (Rp) and the number of gripping members 44*a,* 44*b* which are equally positioned about the support member 22 are known. It is desired to solve for the following unknowns to enable proper workpiece transfer:

| | |
|---|---|
| Ra | Anvil Radius |
| Rs | Gripping member radius |
| $\Theta s(t)$ | Gripping member position as a function of time |
| T | One half of the total transfer time. |

Figure 7:
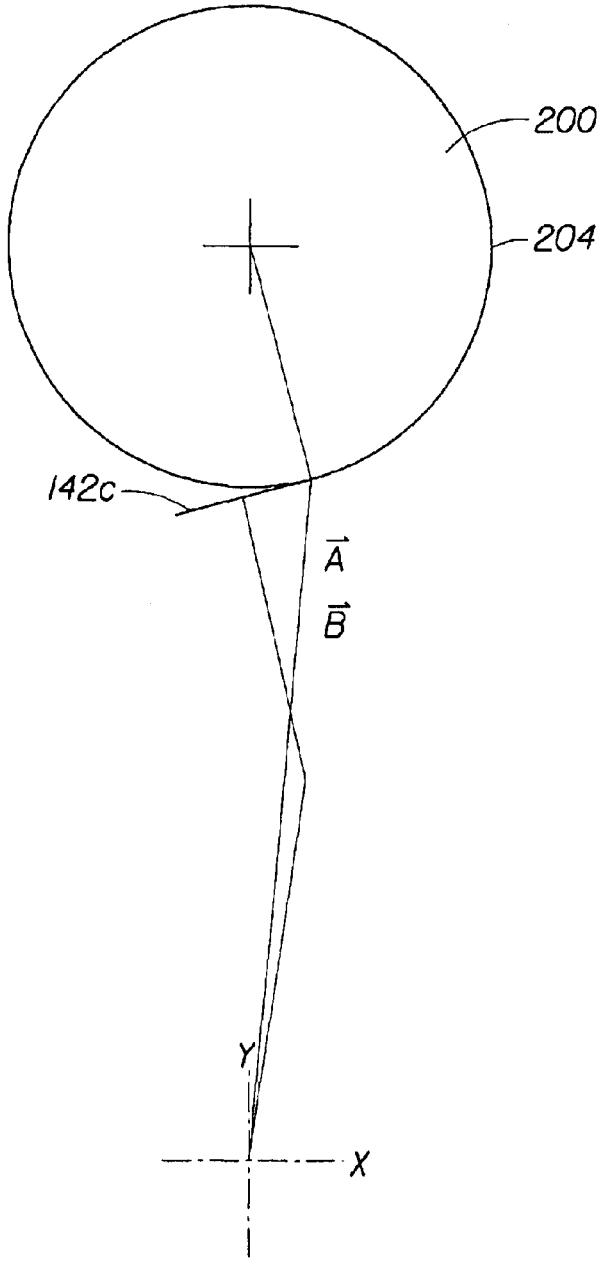
FIG. 7 is a schematic diagram illustrating the position of a transfer point on each of the anvil and workpiece-receiving surface at a particular point in time during transfer of a workpiece and relative to a center point on the support member.

Position (See FIG. 7)

$\vec{A}$ is the position of the transfer point on the workpiece-receiving surface 142*c* as a function of time.

$\vec{A}$ is the position of the desired transfer point on the anvil surface 204 as a function of time.

For perfect anvil surface to workpiece-receiving surface transfer, these two positions should be identical $$\vec{A}-\vec{B}=0$$

$\vec{A}$ and $\vec{B}$ can be split into x and y components.

$$A_x = R_p \cdot \cos(\theta_p(t)) + R_s \cdot \cos(\theta_s(t) + \theta_p(t)) + \frac{t}{T} \cdot \frac{LH}{2} \cdot \sin(\theta_s(t) + \theta_p(t)) \quad \text{EQ. 1}$$

$$A_y = R_p \cdot \sin(\theta_p(t)) + R_s \cdot \sin(\theta_s(t) + \theta_p(t)) - \frac{t}{T} \cdot \frac{LH}{2} \cos(\theta_s(t) + \theta_p(t)) \quad \text{EQ. 2}$$

EQ. 3

$$B_y=R_p+R_s+R_a-R_a \cdot \sin(\theta_s(t)+\theta_p(t)) \quad \text{EQ. 4}$$

For perfect contact, the difference between the x components and the difference between the y components will both be zero.

$$A_x-B_x=0$$

$$A_y-B_y=0$$

Velocity

To ensure proper transfer of pairs of workpieces 100 from the anvil surface 204 to the workpiece receiving surface 142*c*, the transfer rate of the workpieces 100 from the anvil surface 204 to the workpiece receiving surface 142*c* needs to be evaluated. More specifically, to ensure a proper transfer, the change in vectors $\vec{A}$ and $\vec{B}$ with respect to time should be equal. This ensures the transfer point on the workpiece receiving surface 142*c* coincides with the desired transfer point on the anvil surface 204 at any given instance during workpiece transfer. These changes in vector vectors $\vec{A}$ and $\vec{B}$ with respect to time are velocities $\vec{V}_A$ and $\vec{V}_B$ respectively.

$$\vec{V}B=\vec{V}_A$$

$\hat{V}_B$ Velocity of the desired transfer point moving around the anvil surface 204.

$\hat{V}_A$ Velocity of the actual transfer point moving across the workpiece-receiving surface 142c.

$\vec{V}_A$ is made up of x and y components $$\vec{V}_{Ax} = \frac{d}{dt}A_x \text{ and } \vec{V}_{Ay} = \frac{d}{dt}A_y.$$

$\vec{V}_B$ is made up of x and y components $$\vec{V}_{Bx} = \frac{d}{dt}B_x \text{ and } \vec{V}_{By} = \frac{d}{dt}B_y.$$

$$V_{Ax} = -R_p \cdot \sin(\theta_p(t)) \cdot \frac{d}{dt}\theta_p(t) - R_s \cdot \sin(\theta_s(t) + \theta_p(t)) \cdot \left(\frac{d}{dt}\theta_s(t) + \frac{d}{dt}\theta_p(t)\right) \ldots + \frac{1}{2 \cdot T} \cdot LH \cdot \sin(\theta_s(t) + \theta_p(t)) + \frac{1}{2} \cdot \frac{t}{T} \cdot LH \cdot \cos(\theta_s(t) + \theta_p(t)) \cdot \left(\frac{d}{dt}\theta_s(t) + \frac{d}{dt}\theta_p(t)\right) \quad \text{EQ. 5}$$

$$V_{Ay} = R_p \cdot \cos(\theta_p(t)) \cdot \frac{d}{dt}\theta_p(t) + R_s \cdot \cos(\theta_s(t) + \theta_p(t)) \cdot \left(\frac{d}{dt}\theta_s(t) + \frac{d}{dt}\theta_p(t)\right) \ldots + \frac{1}{2 \cdot T} \cdot LH \cdot \cos(\theta_s(t) + \theta_p(t)) + \frac{1}{2} \cdot \frac{t}{T} \cdot LH \cdot \sin(\theta_s(t) + \theta_p(t)) \cdot \left(\frac{d}{dt}\theta_s(t) + \frac{d}{dt}\theta_p(t)\right) \quad \text{EQ. 6}$$

$$V_{Bx} = R_a \cdot \sin(\theta_s(t) + \theta_p(t)) \cdot \left(\frac{d}{dt}\theta_s(t) + \frac{d}{dt}\theta_p(t)\right) \quad \text{EQ. 7}$$

EQ. 8

For perfectly matched velocity between the workpiece-receiving surface 142*c* and the anvil 200, the velocity components will be equal.

$$\vec{V}_{Ax}-\vec{V}_{Bx}=0 \text{ and } \vec{V}_{Ay}-\vec{V}_{By}=0$$

Solution:

Solving Equations A, N, O, P (set out above) and Equation 21 (set out below) simultaneously using an iterative process while maintaining the difference between the first and second transfer point velocities within a desired range, the difference between the third and fourth transfer point velocities within a desired range, both discussed above, an anvil surface/workpiece receiving surface gap ($Gap_A$) within a desired range, discussed below, a workpiece receiving surface/conveyor gap ($Gap_{Conv}$) within a desired range, discussed above, and setting $R_{Conv}$ to a value such that $Gap_{Conv}$ is never less than 0.0 mm, will give the following six unknown variables which need to be determined: anvil radius (Ra), gripping member radius (Rs), gripping member position as a function of time (Θs(t)), one-half of the total workpiece-receiving surface 142*c*/anvil 200 transfer time (T); $R_{Conv}$; and $T_{Conv}$.

More Specific Embodiment:

In this embodiment, it is presumed that the support member and gripping member angular velocities are constant during workpiece transfer.

This leads to some simplifications of the equations.

Constant support member velocity $$\Theta_p(t) = \frac{\pi}{2} - K_p \cdot t \quad \text{EQ. 9}$$

$$\frac{d}{dt}\Theta_p(t) = -K_p \quad \text{EQ. 10}$$

$$\Theta_s(t)=K_s\cdot t \quad \text{EQ. 11}$$

$$\frac{d}{dt}\Theta_s(t) = K_s \quad \text{EQ. 12}$$

Kp=constant representing support member angular velocity during transfer; Ks=constant representing gripping member angular velocity during transfer.

Substituting equations 9–12 into 1–8 gives:

EQ. 13

$$A_x(t) := R_p\cdot\cos\left(\frac{\pi}{2}-K_p\cdot t\right)+ R_s\cdot\cos\left(K_s\cdot t+\frac{\pi}{2}-K_p\cdot t\right)-\frac{t}{T}\cdot\frac{LH}{2}\cdot\sin\left(K_s\cdot t+\frac{\pi}{2}-K_p\cdot t\right) \quad \text{EQ. 13}$$

$$A_y(t) := R_p\cdot\sin\left(\frac{\pi}{2}-K_p\cdot t\right)+ R_s\cdot\sin\left(K_s\cdot t+\frac{\pi}{2}-K_p\cdot t\right)-\frac{t}{T}\cdot\frac{LH}{2}\cdot\cos\left(K_s\cdot t+\frac{\pi}{2}-K_p\cdot t\right) \quad \text{EQ. 14}$$

$$B_x(t) := -R_a\cdot\sin\left(K_s\cdot t+\frac{\pi}{2}-K_p\cdot t-\frac{\pi}{2}\right) \quad \text{EQ. 15}$$

$$B_y(t) := R_p+R_s+R_{aCenter}-R_a\cdot\cos\left(K_s\cdot t+\frac{\pi}{2}-K_p\cdot t-\frac{\pi}{2}\right) \quad \text{EQ. 16}$$

$$V_{Ax} = -R_p\cdot\sin\left(\frac{\pi}{2}-K_p\cdot t\right)\cdot -K_p - R_s\cdot\sin\left[K_s\cdot t+\left(\frac{\pi}{2}-K_p\cdot t\right)\right]\cdot(K_s+-K_p)\ \ldots + \frac{1}{2\cdot T}\cdot LH\cdot\sin\left[K_s\cdot t+\left(\frac{\pi}{2}-K_p\cdot t\right)\right]\ \ldots + \frac{1}{2}\cdot\frac{t}{T}\cdot LH\cdot\cos\left[K_s\cdot t+\left(\frac{\pi}{2}-K_p\cdot t\right)\right]\cdot(K_s+-K_p) \quad \text{EQ. 17}$$

$$V_{Ay} = R_p\cdot\cos\left(\frac{\pi}{2}-K_p\cdot t\right)\cdot -K_p + R_s\cdot\cos\left[K_s\cdot t+\left(\frac{\pi}{2}-K_p\cdot t\right)\right]\cdot(K_s+-K_p)\ \ldots + \frac{1}{2\cdot T}\cdot LH\cdot\cos\left[K_s\cdot t+\left(\frac{\pi}{2}-K_p\cdot t\right)\right]\ \ldots + \frac{1}{2}\cdot\frac{t}{T}\cdot LH\cdot\sin\left[K_s\cdot t+\left(\frac{\pi}{2}-K_p\cdot t\right)\right]\cdot(K_s+-K_p) \quad \text{EQ. 18}$$

$$V_{Bx} = R_a\cdot\sin\left[K_s\cdot t+\left(\frac{\pi}{2}-K_p\cdot t\right)\right]\cdot(K_s+-K_p) \quad \text{EQ. 19}$$

$$V_{By} = -R_a\cdot\cos\left[K_s\cdot t+\left(\frac{\pi}{2}-K_p\cdot t\right)\right]\cdot(K_s+-K_p) \quad \text{EQ. 20}$$

Solution:

Solving Equations A, N, O, P (set out above) and equation 21 (set out below) simultaneously using an iterative process while maintaining the difference between the first and second transfer point velocities within a desired range, the difference between the third and fourth transfer point velocities within a desired range, both discussed above, an anvil surface/workpiece receiving surface gap ($Gap_A$) within a desired range, discussed below, a workpiece receiving surface/conveyor gap ($Gap_{Conv}$) within a desired range, discussed above, and setting $R_{Conv}$ to a value such that $Gap_{Conv}$ is never less than 0.0 mm, will give the following six unknown variables which need to be determined: anvil radius (Ra), gripping member radius (Rs), gripping member position as a function of time (Θs(t)), one-half of the total transfer time (T); $R_{Conv}$; and $T_{Conv}$.

Gap or Interference Between Anvil Surface and the Workpiece-Receiving Surface:

The gap or interference is the difference between the anvil radius (Ra) and the shortest distance between the workpiece-receiving surface and the anvil center of rotation at a given time.

Line 1 below represents the workpiece-receiving surface 142*c* and Line 2 (not shown) represents a line perpendicular to the workpiece-receiving surface which passes through the anvil center of rotation. Point $(x_1,y_1)$ is at the center of the Workpiece-receiving surface. Point $(x_2,y_2)$ is the anvil center of rotation.

Line 1

Slope: $s_1(t) = \tan(K_s t - K_p t)$ $$x_1(t) = R_p\cos\left(\frac{\pi}{2}-K_p t\right)+R_s\cos\left(\frac{\pi}{2}+K_s t-K_p t\right)$$

$$y_1(t) = R_p\sin\left(\frac{\pi}{2}-K_p t\right)+R_s\sin\left(\frac{\pi}{2}+K_s t-K_p t\right)$$

Line 2

Slope: $s_2(t) = \dfrac{-1}{\tan(K_s t - K_p t)}$ $x_2(t) = 0$ $y2(t) = R_p + R_s + R_a$ The intersection of these two lines is:

$$x_{int}(t) = \frac{y_2(t)-y_1(t)+s_1(t)\cdot x_1(t)-s_2(t)\cdot x_2(t)}{s_1(t)-s_2(t)}$$

$$y_{int}(t) = \frac{-y_1(t)\cdot s_2(t)+s_1(t)\cdot y_2(t)-s_1(t)\cdot s_2(t)\cdot x_2(t)+s_1(t)\cdot s_2(t)\cdot x_1(t)}{s_1(t)-s_2(t)}$$

The gap is then represented by:

$$Gap_A = \sqrt{(x_{int}(t)-x_2(t))^2+(x_{int}(t)-x_2(t))^2}\ -R_a \quad \text{EQ. 21}$$

If $Gap_A$ is positive, then there is a clearance between the workpiece-receiving surface 142*c* and the anvil 200. If it is negative, then there is interference. The maximum Gap/Interference is found by evaluating $Gap_A$ over the full range of time (t) from −T to T.

As noted above, it is preferred that the maximum $Gap_A$ over the range of time (t) from −T to T between the nearest point on a planar workpiece-receiving surface 142*c* of the gripping member 44*a,* 44*b,* to a corresponding, opposing point on a first workpiece 100 secured to anvil outer surface 204 during workpiece transfer be between about 0 mm and 2 mm.

With regard to the gap between the workpiece-receiving surface 142*c* and the conveyor, if $Gap_{Conv}$ is positive, then there is a clearance between the workpiece-receiving surface 142*c* and the conveyor 300. If it is negative, then there is interference. The maximum Gap/Interference is found by evaluating $Gap_{Conv}$ over the full range of time (t) from $-T_{conv}$ to $T_{conv}$.

It is preferred that the maximum $Gap_{Conv}$ (determined using the following equation as noted above: $Gap_{Conv}=R_{Conv}-H_{max}$) over the range of time (t) from $-T_{conv}$ to $T_{Conv}$ between the nearest point on a planar workpiece-receiving surface 142*c* of the gripping member 44*a,* 44*b,* to a corresponding, opposing point on the conveyor 300 during workpiece transfer be between about 0 mm and 2 mm.

The above discussion is based on transferring a theoretical workpiece 100 with a zero thickness. In practice, for a workpiece 100 with a non-zero thickness, D, that thickness needs to be considered. More specifically, if the gap ($Gap_A$ or $Gap_{Conv}$) for the zero thickness workpiece 100 was found to be 0, then the gap ($Gap_A$ or $Gap_{Conv}$) for a workpiece 100 with thickness D will be 0–D or –D, where the negative implies an interference or crash situation. In order to maintain the gap ($Gap_A$ or $Gap_{Conv}$) within a desired range to ensure proper workpiece transfer, the gripping member radius $R_s$ needs to be adjusted for the workpiece thickness, D. More specifically, the gripping member radius of the actual equipment will be the gripping member radius from the zero thickness workpiece solution ($R_s$) minus the workpiece thickness, D. It should be noted that after selecting the actual gripping member radius for a first workpiece 100 of thickness, D, there is some range of first workpiece thicknesses less than D where the resulting gap will still fall within the desired range, thus enabling, without modification, the use of the same gripping member radius for a multiplicity of workpiece thicknesses, D.

What is claimed is:

1. A transfer apparatus for transferring a workpiece from a first location to a second location comprising:

a support structure comprising a support member rotatable about a first axis; and a first drive motor for effecting rotation of said support member about said first axis; and a workpiece gripping structure mounted to said support structure comprising at least one workpiece gripping member having a workpiece-receiving surface, said gripping member being rotatable about a second axis substantially parallel to said first axis such that said gripping member is rotatable about said second axis during transfer of a workpiece from the first location to said workpiece-receiving surface, and said workpiece gripping structure further comprising a second drive motor for effecting rotation of said workpiece gripping member about said second axis, said workpiece grippin member also being rotatable about a third axis substantially perpendicular to said first and second axes so as to be capable of rotating said workpiece transferred to said workpiece-receiving surface through an angle, and said workpiece gripping structure further comprising a third drive motor for effecting rotation of said workpiece gripping member about said third axis, said first, second and third drive motors are independetly-controlled servo drive motors.

2. A transfer apparatus as set forth in claim 1, wherein said workpiece gripping member comprises a substantially planar workpiece-receiving surface.

3. A transfer apparatus as set forth in claim 1, further comprising structure for holding said workpiece to said workpiece-receiving surface.

4. A transfer apparatus as set forth in claim 3, wherein said holding structure comprises openings in a plate of said workpiece gripping member, an outer surface of said plate defining said workpiece-receiving surface of said gripping member, said holding structure further comprising a vacuum chamber in said gripping member communicating with said openings and a vacuum source for drawing at least a partial vacuum in said vacuum chamber such that a workpiece positioned adjacent to said workpiece-receiving surface is gripped by said receiving surface during operation of said vacuum source.

5. A transfer apparatus as set forth in claim 4, wherein said vacuum source is mounted to said support member.

6. A transfer apparatus as set forth in claim 5, wherein said vacuum source comprises a venturi vacuum pump.

7. A transfer apparatus as set forth in claim 1, wherein said second and third drive motors are mounted so as to rotate with said support member.

8. A transfer apparatus as set forth in claim 1, wherein said first drive motor effects rotation of said support member about said first axis in a first direction and said second drive motor effects rotation of said workpiece gripping member about said second axis in a second direction, opposite said first direction.

9. A transfer apparatus as set forth in claim 1, wherein said at least one workpiece gripping member comprises first and second workpiece gripping members, said first and second gripping members being supported by a common support element, and said workpiece gripping structure further comprising a drive motor coupled to said support element for effecting rotation of said support element.

10. A transfer apparatus as set forth in claim 9, wherein said first and second gripping members are adjustably coupled to said common support element.

11. A transfer apparatus as set forth in claim 1, wherein a velocity of a first transfer point moving along said workpiece-receiving surface is substantially equal to a velocity of a second transfer point moving along a surface of the first location during workpiece transfer and a gap between a nearest point on said planar workpiece-receiving surface of said gripping member to a corresponding, opposing point on the first location surface is between about 0 mm and 2 mm during workpiece transfer.

12. A transfer apparatus as set forth in claim 11, wherein any difference between said first and second transfer point velocities falls within a range of from about –2.0% and about +2.0%.

13. A transfer apparatus as set forth in claim 11, wherein a plurality of workpieces are provided at the first location positioned in an abutting relationship or spaced apart from one another by a first distance and said workpieces are transferred to the second location by said at least one workpiece gripping member such that the workpieces are spaced apart by a second distance different from said first distance.

14. A transfer apparatus as set forth in claim 1, wherein the workpiece is cut from a web of material.

15. A transfer apparatus as set forth in claim 1, wherein said third drive motor is mounted so as to rotate with said workpiece gripping structure.

16. A transfer apparatus for transferring a workpiece from a moving anvil to a moving carrier comprising:

a support structure comprising a support member rotatable about a first axis; and a workpiece gripping structure mounted to said support structure comprising at least one workpiece gripping member having a workpiece-receiving surface, said gripping member being rotatable about a second axis substantially parallel to said first axis such that said gripping member is capable of being rotated about said second axis during transfer of a workpiece from the moving anvil to said workpiece-receiving surface, and said workpiece gripping member being rotatable about a third axis substantially perpendicular to said first and second axes so as to be capable of rotating said workpiece from a first angular position at said anvil to a second angular position, wherein said support structure further comprises a first drive motor for effecting rotation of said support member about said first axis, and said workpiece gripping structure further comprises a second drive motor for effecting rotation of said workpiece gripping member about said second axis and a third drive motor for effecting rotation of said workpiece gripping member about said third axis, wherein each of said first, second and third drive motors comprises a servo drive motor.

17. A transfer apparatus as set forth in claim 16, wherein said second and third drive motors are mounted so as to rotate with said support member.

18. A transfer apparatus as set forth in claim 16, wherein said first drive motor effects rotation of said support member about said first axis in a first direction and said second drive motor effects rotation of said workpiece gripping member about said second axis in a second direction, opposite said first direction.

19. A transfer apparatus for transferring a workpiece from a moving anvil to a moving carrier comprising:

a support structure comprising a support member rotatable about a first axis and a first drive motor for effecting rotation of said support member about said first axis; and a workpiece gripping structure comprising at least one workpiece gripping member having a workpiece-receiving surface, said gripping member being rotatable about a second axis substantially parallel to said first axis such that said gripping member is rotatable about said second axis during transfer of a workpiece from the moving anvil to said workpiece-receiving surface, and said workpiece gripping structure further comprising a second drive motor for effecting rotation of said workpiece gripping member about said second axis, said first and second drive motors comprising servo drive motors, wherein said workpiece gripping member is rotatable about a third axis substantially perpendicular to said first and second axes so as to be capable of rotating said workpiece transferred to said workpiece-receiving surface through an angle, and said workpiece gripping structure further comprises a third servo drive motor for effecting rotation of said workpiece gripping member about said third axis.

20. A transfer apparatus as set forth in claim 19, wherein said second and third servo drive motors are mounted so as to rotate with said support member.

* * * * *

UNITED STATES PATENT AND TRADEMARK OFFICE

CERTIFICATE OF CORRECTION

PATENT NO. : 6,942,086 B2
DATED : September 13, 2005
INVENTOR(S) : Russell Pearce Bridges et al.

It is certified that error appears in the above-identified patent and that said Letters Patent is hereby corrected as shown below:

Column 21,
Line 37, delete “grippin” and insert -- gripping --.

Signed and Sealed this

Third Day of January, 2006

JON W. DUDAS
*Director of the United States Patent and Trademark Office*